US008777459B2

(12) United States Patent
Patti et al.

(10) Patent No.: US 8,777,459 B2
(45) **Date of Patent: *Jul. 15, 2014**

(54) RECESSED LUMINAIRE

(71) Applicant: Focal Point L.L.C., Chicago, IL (US)

(72) Inventors: Anthony G. Patti, Alta Loma, CA (US); Stephene H. Yuen, Darien, IL (US); Peter F. Thornton, Jr., Hinsdale, IL (US); David E. Doubek, LaGrange, IL (US)

(73) Assignee: Focal Point, L.L.C., Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/782,855

(22) Filed: Mar. 1, 2013

(65) Prior Publication Data

US 2013/0176742 A1 Jul. 11, 2013

Related U.S. Application Data

(63) Continuation of application No. 13/355,143, filed on Jan. 20, 2012, now Pat. No. 8,408,758, which is a continuation of application No. 12/814,715, filed on Jun. 14, 2010, now Pat. No. 8,100,565, which is a continuation of application No. 11/735,807, filed on Apr. 16, 2007, now Pat. No. 7,748,868.

(60) Provisional application No. 60/865,832, filed on Nov. 14, 2006.

(51) Int. Cl.
*F21V 14/02* (2006.01)

(52) U.S. Cl.
USPC ..... 362/364; 362/287; 362/365

(58) Field of Classification Search
USPC ..... 362/147, 285, 287, 364, 365, 366, 371, 362/372, 427, 428
See application file for complete search history.

(56) References Cited

U.S. PATENT DOCUMENTS 2,401,390 A 6/1945 Unger (Continued)

FOREIGN PATENT DOCUMENTS

| | | |
|---|---|---|
| CA | 2552267 | 1/2007 |
| EP | 750159 | 12/1996 |
| EP | 1657486 | 5/2006 |

OTHER PUBLICATIONS

Canadian Office Action from Canadian Patent Application No. 2,610,520 dated Jan. 15, 2014.

(Continued)

*Primary Examiner* — Y My Quach Lee
(74) *Attorney, Agent, or Firm* — Banner & Witcoff, Ltd.

(57) ABSTRACT

In an embodiment, a luminaire may include a housing that includes a support panel, a rotation ring supported by the support panel where the rotation ring is infinitely adjustable with a range of adjustments with respect to the support panel, a rotation drive unit configured to rotate the rotation ring with respect to the support panel, an aiming frame supported by the rotation ring, a tray system pivotally mounted to the aiming frame and configured to receive the bulb, and a tray drive configured to rotate the tray system about the pivotal mounting, whereby, in operation the rotational and angular orientation of the bulb may be adjusted while the bulb is on.

24 Claims, 39 Drawing Sheets

(56) References Cited

U.S. PATENT DOCUMENTS

| | | | | |
|---|---|---|---|---|
| 3,697,742 | A | 10/1972 | Bobrick | |
| 5,130,914 | A * | 7/1992 | Bengochea | 362/364 |
| 5,291,381 | A | 3/1994 | Price | |
| 5,373,431 | A | 12/1994 | Hayman et al. | |
| 5,465,199 | A | 11/1995 | Bray et al. | |
| 5,562,343 | A | 10/1996 | Chan et al. | |
| 5,609,408 | A | 3/1997 | Targetti | |
| 6,471,374 | B1 | 10/2002 | Thomas et al. | |
| 6,652,124 | B2 | 11/2003 | Schubert et al. | |
| 7,186,008 | B2 | 3/2007 | Patti | |
| 2003/0161153 | A1 | 8/2003 | Patti | |
| 2006/0193142 | A1 | 8/2006 | Dupre | |
| 2007/0019418 | A1 | 1/2007 | Czech et al. | |

OTHER PUBLICATIONS

Focal Point online catalogue; ID: The Intelligent Downlight; Accent Pinhole with Lens, Jan. 2008.

Lucifer Lighting Company online catalogue; Round Adjustable Gear Driven; Product No. DL2GZ-W, Mar. 13, 2008.

Lucifer Lighting Company online catalogue; Round Adjustable Downlight; Product No. DL2GZ, 2007.

Lighting Design Lab News, Winter/Spring 2003, p. 3; "Ceramic Metal Halide" by Shaun Darragh LC, 2008.

Cooper Lighting online catalogue; Iris Lighting Systems P5.

Cooper Lighting online catalogue; RSA Lighting; Accurus Trim ACT 1885 5" Square Recessed Adjustable Fixture, Dec. 2007.

Extended European Search Report in related European Application No. 07022141.1; dated Jul. 28, 2011.

* cited by examiner

RECESSED LUMINAIRE

CROSS-REFERENCE TO RELATED APPLICATIONS

This application is a continuation application to U.S. Non-Provisional application Ser. No. 13/355,143, filed Jan. 20, 2012, now U.S. Pat. No. 8,408,758, which is a continuation application to U.S. Non-Provisional application Ser. No. 12/814,715, filed Jun. 14, 2010, now U.S. Pat. No. 8,100,565, which is a continuation application to U.S. Non-Provisional application Ser. No. 11/735,807, filed Apr. 16, 2007, now U.S. Pat. No. 7,748,868 which claims priority to U.S. Provisional Application Ser. No. 60/865,832, filed Nov. 14, 2006, which are incorporated herein by reference in their entirety.

BACKGROUND OF THE INVENTION

1. Field of the Invention

The present invention relates to the field of luminaires, more particularly to the field of luminaires that may be installed in a recessed manner.

2. Description of Related Art

Light fixtures or luminaires are commonly used in a variety of commercial and residential settings. While many types of luminaires exist, one popular type is a recessed bulb luminaire. The advantage of a recessed bulb luminaire, depending on the design, is that housing of the luminaire may be mounted in the ceiling or wall so that it does not noticeably extend beyond the mounting surface, thus providing a cleaner appearance when the luminaire is installed.

A luminaire being installed in a ceiling is typically installed by first mounting a housing to a one or more ceiling supports so that the housing is aligned with the planned surface of the ceiling. This alignment process can be difficult as the actual surface is not there when the housing is being aligned. Next a surface material, which may be drywall, drop ceiling tiles or any other suitable surface material, is installed after the housing of the luminaire is installed. To allow the luminaire to function, a hole is provided in the surface. Often a trim plate with a transparent lens and a flange is attached to the housing so as to cover up an edge of the hole, as well as internal components of the luminaire. The result is a recessed luminaire that provides light as desired while provide a relatively pleasing aesthetic appearance.

Once the luminaire is installed, the bulb may need to be aimed. Current luminaires make it difficult to aim the bulb (or lamp) while the luminaire is on, thus adjusting the aim often requiring turning the power off, partially disassembling the luminaire, making an adjustment in the bulb aiming assembly, reassembling the luminaire and then turning the power back on to see if the adjustment correctly aimed the bulb in the desired direction. This process is made more troublesome if one or more lens and/or filters are used to shape the light emitted from the bulb because often the lens and/or filters need to be carefully orientated. Plainly, such a process is tedious and time consuming and thus expensive; however, such a process allows the luminaire to provide a variety of lighting effects in addition to down lighting, such as accent or wall-wash lighting.

Eventually the bulb in the luminaire will fail, either catastrophically or due to reduced light output, and will need to be replaced. Current luminaires make it difficult to quickly change the bulb. In addition, sometimes the luminaire must be partially disassembled when the bulb is changed, thus potentially modifying the aim of the luminaire that was previously painstakingly set. As substantial time and money may have been invested in aiming the bulb at a particular point in the first place, modifying of the aiming of the bulb during the process of changing a bulb is generally undesirable. As can be appreciated, this is a significant problem for installations where a larger number of luminaires are installed and each luminaire is separately aimed so as to provide a desired lighting effect.

To make matters worse, as noted above, certain luminaires include filters or accessory lenses that provide additional visual effects such as grids or other light patterns. Often the light patterns are designed to have a particular effect and therefore both the aiming of the bulb and the orientation of the filters need to be relatively precise. However, current luminaires tend to allow or cause the filters to be inadvertently moved during the changing of the bulb, thus undesirably changing the effect the original light pattern was supposed to provide. Therefore, improvements in luminaire design would be desirable for certain circumstances.

BRIEF SUMMARY OF THE INVENTION

A recessed luminaire is provided. The luminaire may be mounted in a housing and the housing may support a transformer. The housing may be supported by adjustable supports that allow the housing to be positioned relative to a first side of a surface. An adaptor, which may be supported by the housing, may extend in an opening of the surface to or near a second side of the surface. The adaptor may be configured so as to allow its position to be adjusted separate from the housing so as to accommodate a range of surface thicknesses. The adaptor may be configured to be mudded or plastered into place so as to provide a substantially continuous surface appearance. The luminaire may include a trim plate that is configured to be partially disassembled from the luminaire and to hang out of the way. The luminaire may include an angle orientation feature. The luminaire may include a rotation adjustment feature. The luminaire may be configured to allow simultaneous adjustment of the angle orientation and rotation adjustment features and the luminaire may be configured to allow for adjustment while the bulb is on. The luminaire may include a locking feature that allows a bulb to be replaced without adjusting the aim or other desired settings of the luminaire during the bulb replacement while minimizing the size of the opening required.

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

BRIEF DESCRIPTION OF THE DRAWINGS

The present invention is illustrated by way of example and not limited in the accompanying figures in which like reference numerals indicate similar elements and in which.

DETAILED DESCRIPTION OF THE INVENTION

As is apparent from the Figures described above and the description provided below, various components are disclosed below and may be mounted to other components. Mounting may be direct or indirect and this disclosure is not intended to be limiting in this respect. It is noted that various component are described below as separate components. Two or more of these components may be combined to form a single component as appropriate and this disclosure is not intended to be limiting in this respect.

In addition, various features are described below in greater detail. It should be noted that different combinations of these features may be combined as desired to generate luminaires with more or less features, depending on the features that are needed. Thus, it is envisioned that additional luminaires using combinations of the below described features are within the scope of the present invention.

Certain embodiments of the present invention are directed towards a luminaire that may include features such as the ability to aim the fixture while the fixture is in operation (hot aiming or the feature of being hot aimable). While hot aiming is a useful feature in and of itself, additional benefits can be gained if there is a separate rotation adjustment and angular orientation adjustment. Such a configuration allows the installer to more quickly adjust either the rotational orientation or the angular orientation without concern that they are adjusting the other. Furthermore, this can also allow the simultaneous adjustment of both angular and rotational orientation, which can allow for a quicker adjustment process, especially if filters or lenses are used to provide additional visual effects. For example, the affect of a grid pattern may be more carefully aimed by simultaneously adjusting the angular and rotational orientation of the bulb. Other potential benefits will become clear after a further review of the disclosure provided below.

Figure 1:
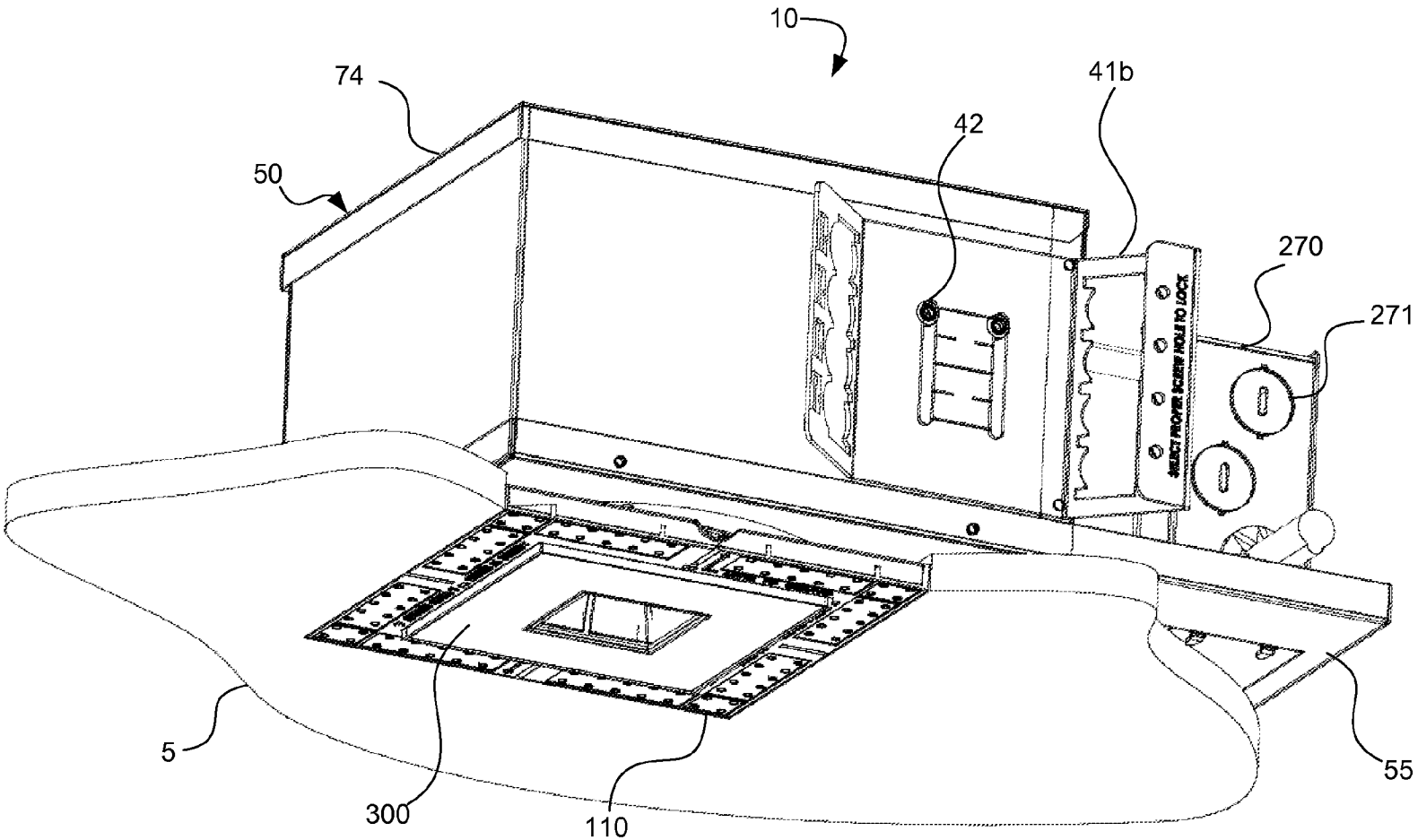
FIG. 1 illustrates an isometric view of an embodiment of a luminaire positioned adjacent a surface.
Figure 2A:
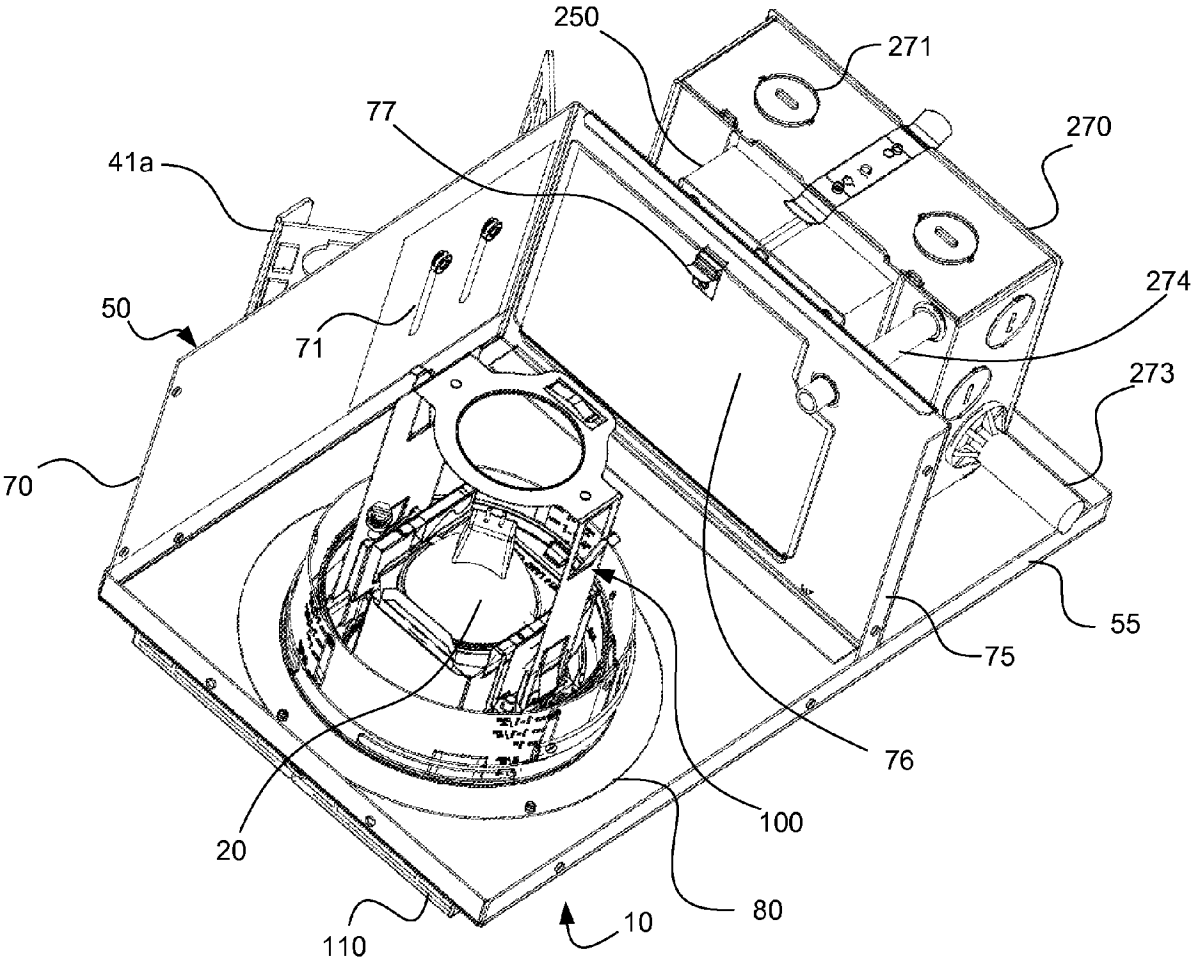
FIG. 2*a* illustrates an isometric view of an embodiment of a luminaire with a portion of a housing removed.
Figure 2B:
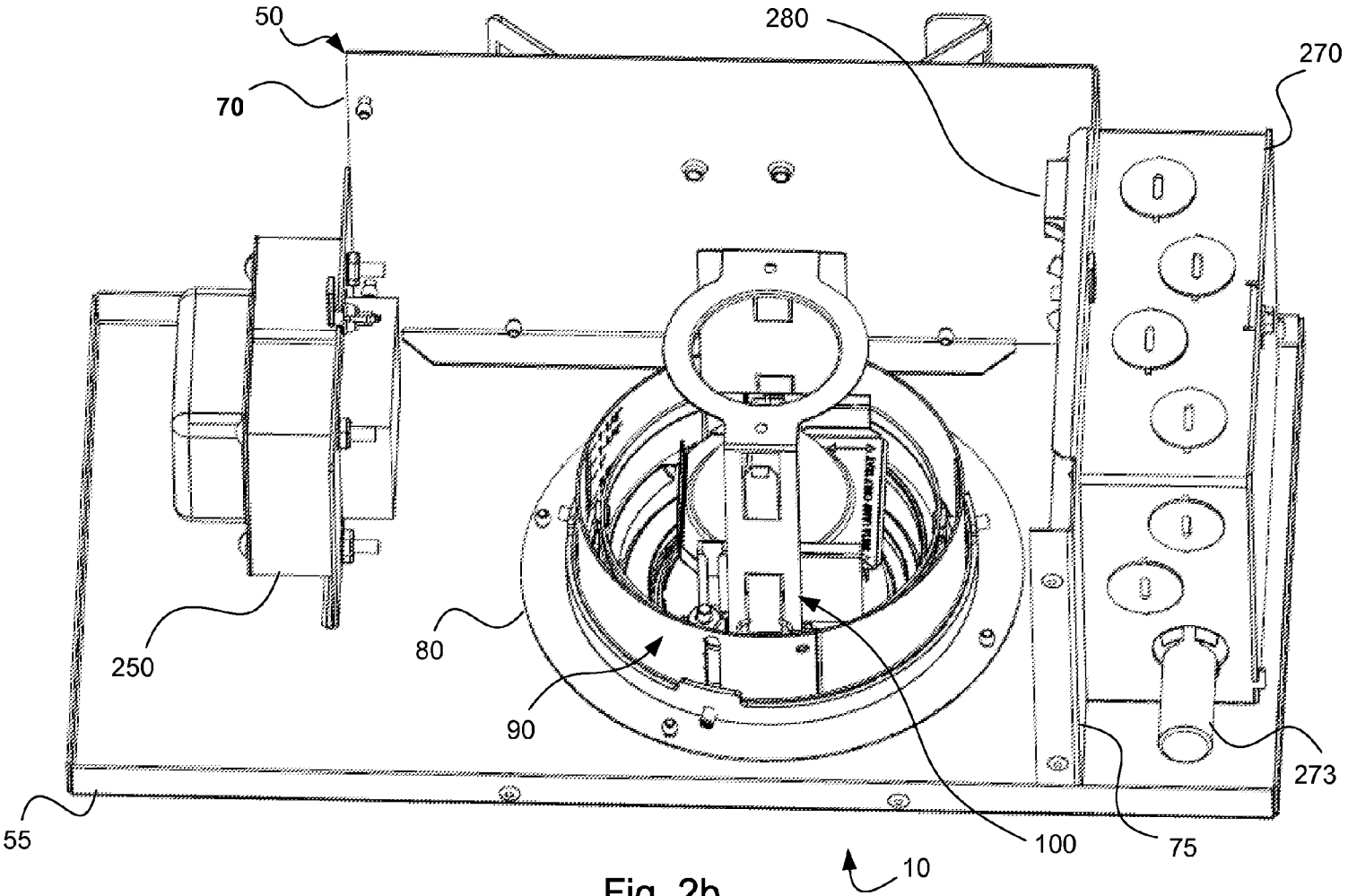
FIG. 2*b* illustrates an isometric view of another embodiment of a luminaire with a portion of a housing removed.
Figure 3:
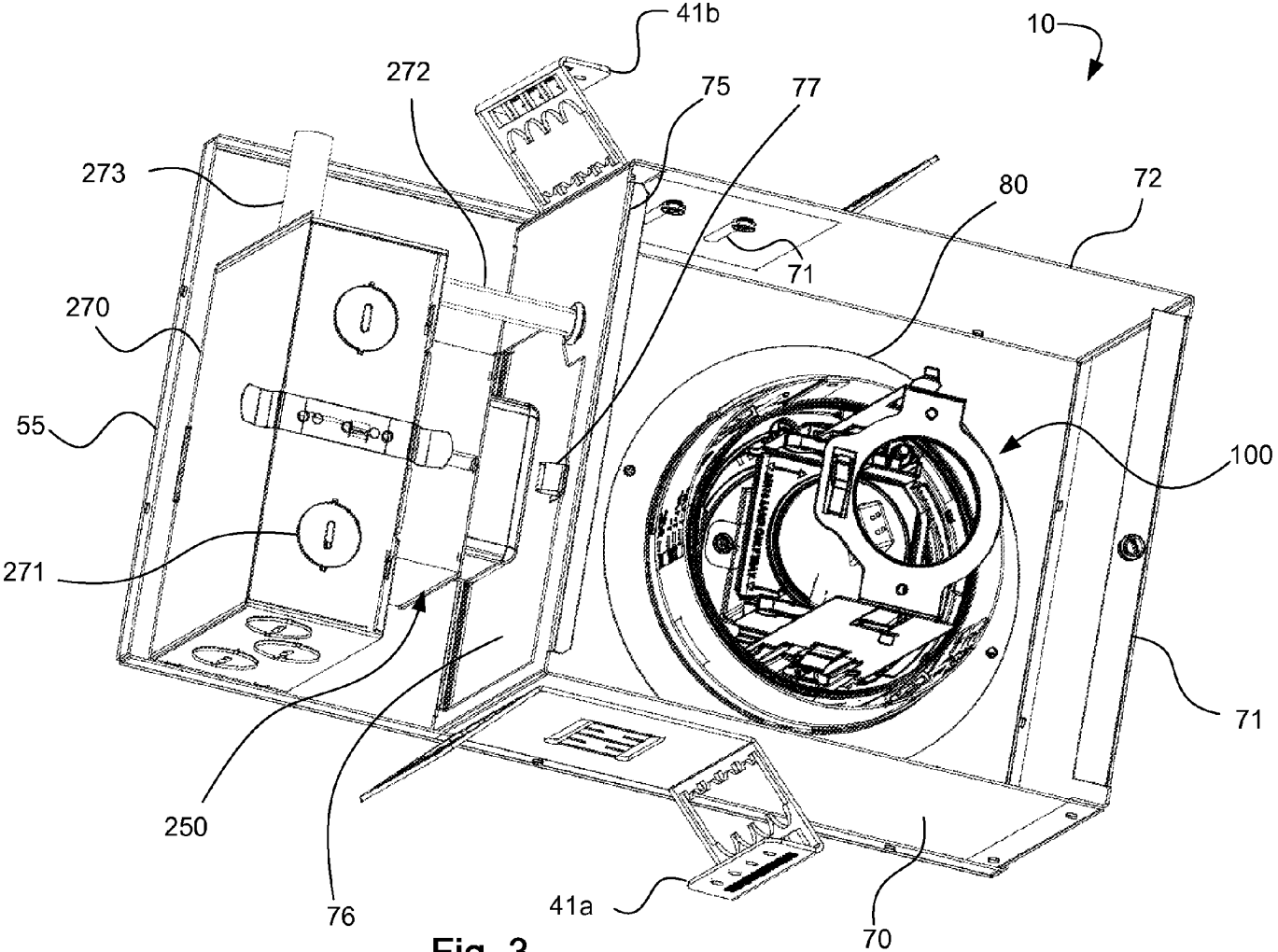
FIG. 3 illustrates an isometric view of an embodiment of a luminaire with a portion of the housing removed.

Turning to FIGS. 1-3, embodiments of a luminaire 10 are depicted. In particular, FIGS. 1, 2*a* and 3 illustrate a first embodiment and FIG. 2*b* illustrates a second embodiment. The luminaire 10 includes a housing 50 with a first panel 74, a second panel 70, a third panel 75, and a support panel 55. The housing 50, which may be made of any desirable material, such as but not limited to aluminum or steel, provides a certain level of protection for the luminaire and also can protect the surrounding area from heat produced by a bulb 20. For a given bulb and material selection, as an internal volume of the housing 50 decreases the temperature of the housing 50 can be expected to rise, thus larger housings 50 may be more suitable for use in situations where materials such as insulation are positioned next to or in contact with the housing 50. An optional support bracket 41*a* and 41*b*, which are shown adjustably mounted to the housing 50 via slots 71 and fastener 42, may be used to support the housing 50 with respect to a mounting support (not shown), such as a stud in a ceiling or wall as is typically used in the construction of buildings. The housing 50 may be mounted on one side of a surface 5 while an adaptor 110 and a trim plate 300 are provided so as to be visible from the second side as depicted in FIG. 1. As can be appreciated, a junction box 270 may be supported by the housing 50, for example the support panel 55 or may be mounted separately as desired.

Regarding the mounting to the surface 5, in an installation where the surface 5 is drywall or some other appropriate material, the luminaire 10 may be mudded into place and a cover such as trim plate 300 may be used to cover up the internal components. However, as can be appreciated, different surface thicknesses make it more difficult to provide a single luminaire that can accommodate the needed range of surface thickness, especially if the luminaire is to be mudded into place.

Looking at FIGS. 2-3, one or more panels of the housing 50 are omitted so as to show additional features of the luminaire 10. The luminaire 10 may include a bulb aiming system 100 for aiming the bulb 20 (which may be any desirable bulb type) that is compatible with a transformer 250. The transformer 250 may operate so as to increase the supply voltage frequency (which normally is 50 or 60 hertz) and/or to modify the voltage being provided to the bulb 20 during operation. However, depending on the bulb design and the need, if any, for shaping the electrical power provided to the luminaire, the separate transformer may be omitted and a transformer may be incorporated into the bulb itself.

It should be noted that panel 70, which is mounted to support panel 55, is coupled to the panel 75. In an embodiment, the panel 75 includes a door 76 that is secured to the panel 75 via attachment feature 77. Thus, it is possible to remove the door 76 and have access to transformer 250 without the need for substantial disassembly. If desired, a junction box 270 may be coupled to the transformer 250 and the junction box 270 may include knock-outs 271 for coupling the junction box to electrical conduit in a known manner. To provide for the routing of wires between the junction box 270 and the housing 50, a tube 274 may be provided. Wires may be routed into the junction box 270 via threaded pipe 274. If desired, the transformer 250 may be supported by the junction box 270 and the junction box 270 may be supported by support panel 55 as depicted so as provide a space efficient packaging that provides ready access to the transformer 250 so as to allow the transformer to be readily changed so that a different type of bulb may be used. Additional brackets may also be mounted to the junction box 270 in a desired manner.

Alternatively, as depicted in FIG. 2*b*, the transformer 250 may be mounted separate from the junction box 270. An advantage of the configuration shown in FIG. 2*b* is that the separation of the transformer 250 and the junction box 270 reduces the number of wires that must be contained within the junction box 270, thus making it easier to install and make adjustments to the wiring. In such a configuration, one or more connectors, such as connector 280, may be used to allow wires (not shown for purpose of clarity) that extend between the transformer 250 and the junction box 270 to quickly be plugged into and electrically connected. Similarly, a wire with a connector may extend from the transformer 250 so as to engage a connector 25 on a wire 24 (FIG. 9) that runs to the bulb 20. The electrical connector may be configured as appropriate to handle the necessary voltage and current while providing the desired retention and may include a feedback feature to indicate two mating connectors are solidly joined.

Figure 4:
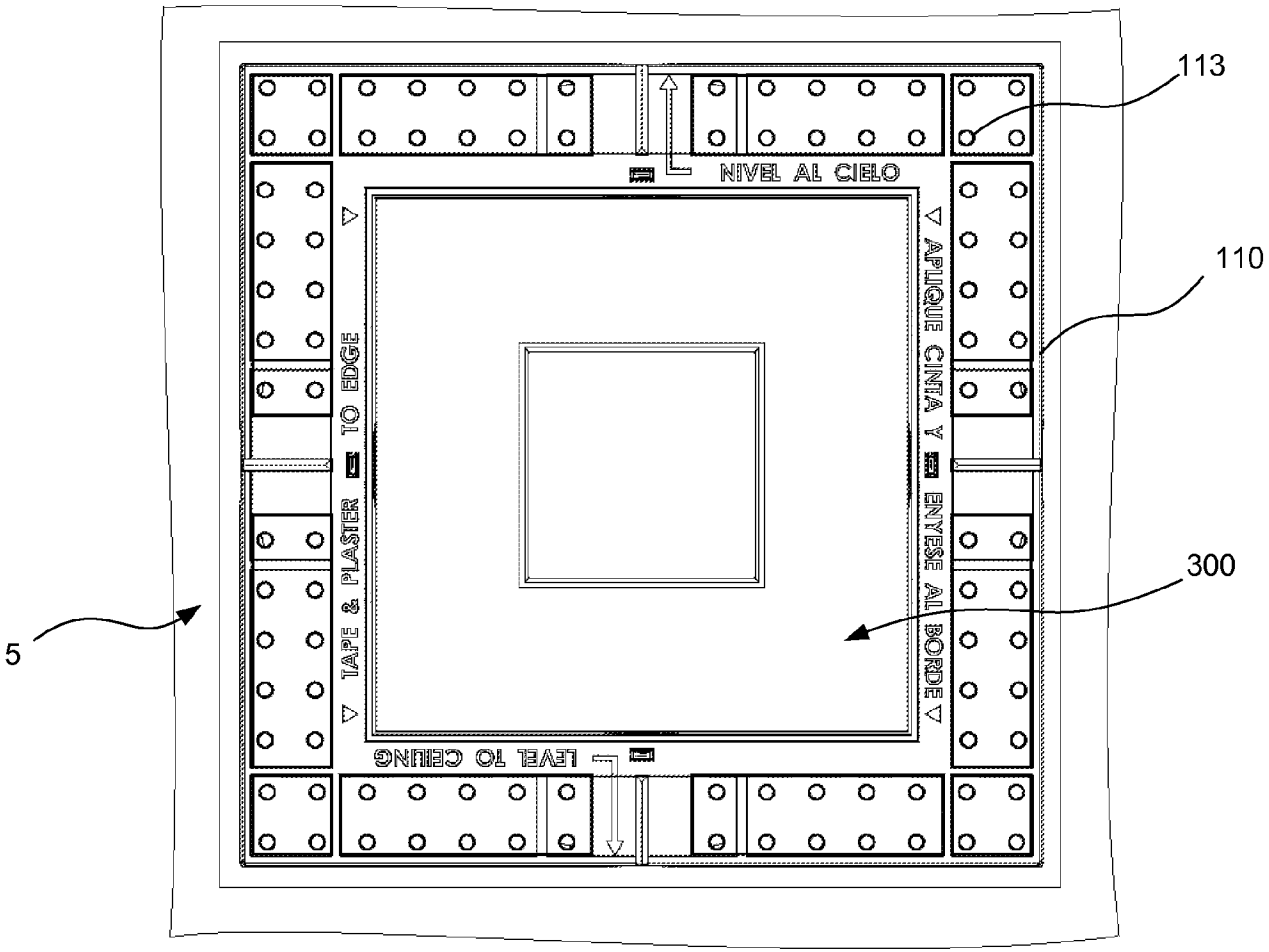
FIG. 4 illustrates a plan view of an embodiment of an adaptor positioned in a hole in a surface.
Figure 5:
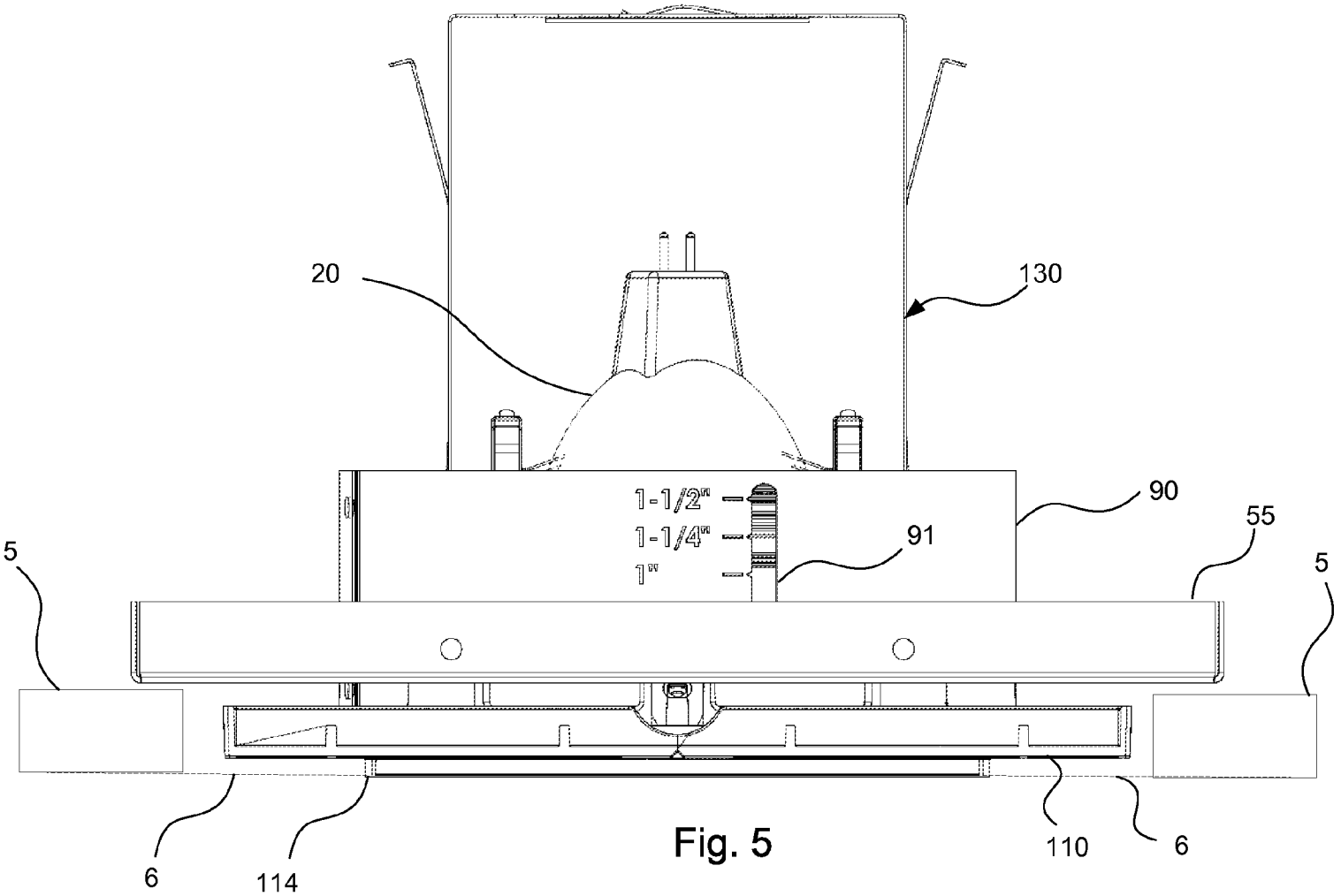
FIG. 5 illustrates a partial side view of an embodiment of a luminaire mounted in a surface.
Figure 19:
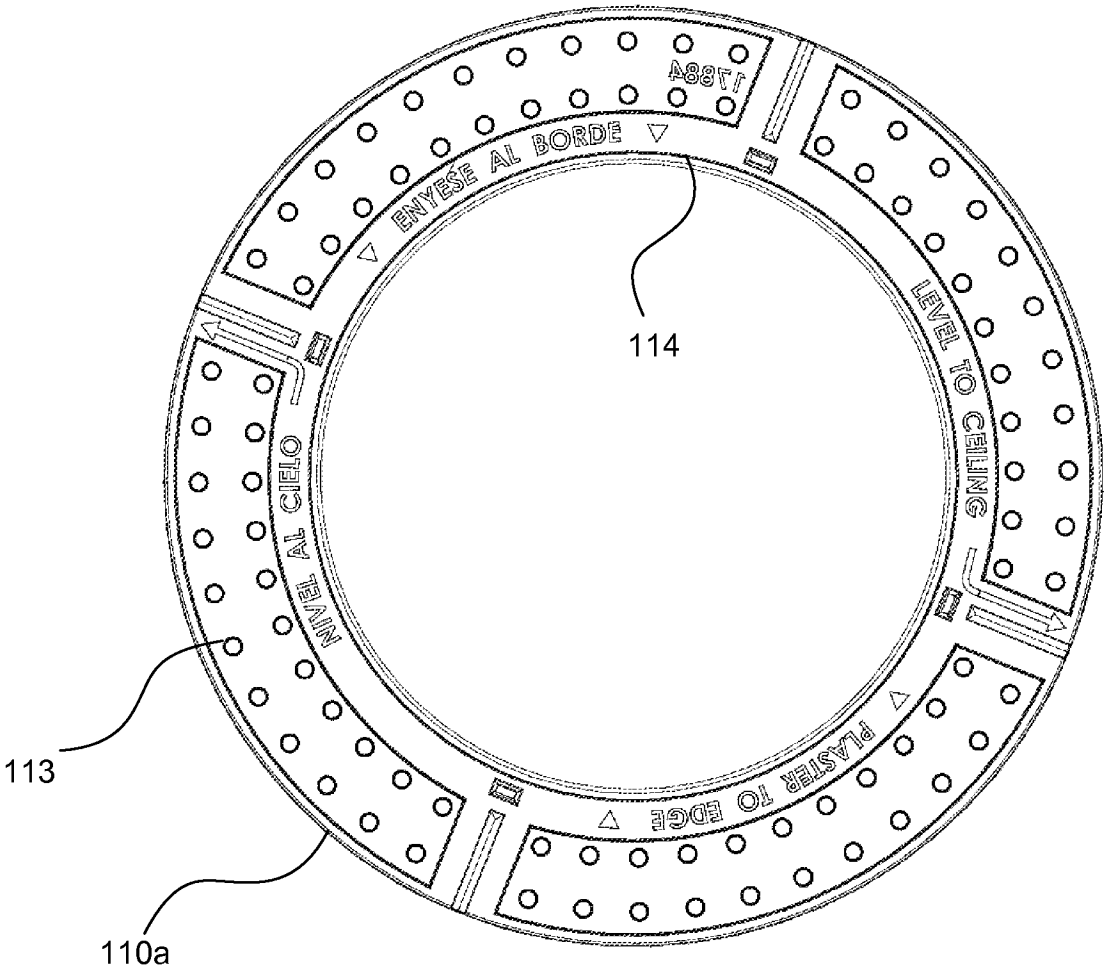
FIG. 19 illustrates a plan view of an embodiment of an adaptor that may be used in conjunction with the trim plate depicted in FIG. 18.

FIGS. 4 and 5 illustrate an embodiment of a luminaire with a square adaptor 110 and a flush square trim plate 300 that can be installed in a surface 5. The general features of the installation of the square adaptor 110 and flush square trim plate 300 are common with how a circular shaped adaptor 110 and flush circular trim plate 300 could be installed, an embodiment of a circular trim plate 300 being shown in FIG. 19. As can be appreciated, however, one significant difference between a circular trim such as shown in FIG. 19, and non-circular shapes such as depicted in FIG. 4, is that it is often desirable to orientate non-circular shapes in a particular or consistent manner, especially if there are multiple light fixtures. For example, it is customary to try to orient the luminaire with a square trim plate 300 so that if there are multiple fixtures installed on the same surface, all the square trim plates 300 provide the appearance of having the same orientation. To align square-shaped adaptors 110, all the adaptors 110 should be orientated substantially the same or have an orientation that is some factor of 90 degrees different. Other non-symmetrical shapes may require an identical orientation in order to match up.

Figure 17:
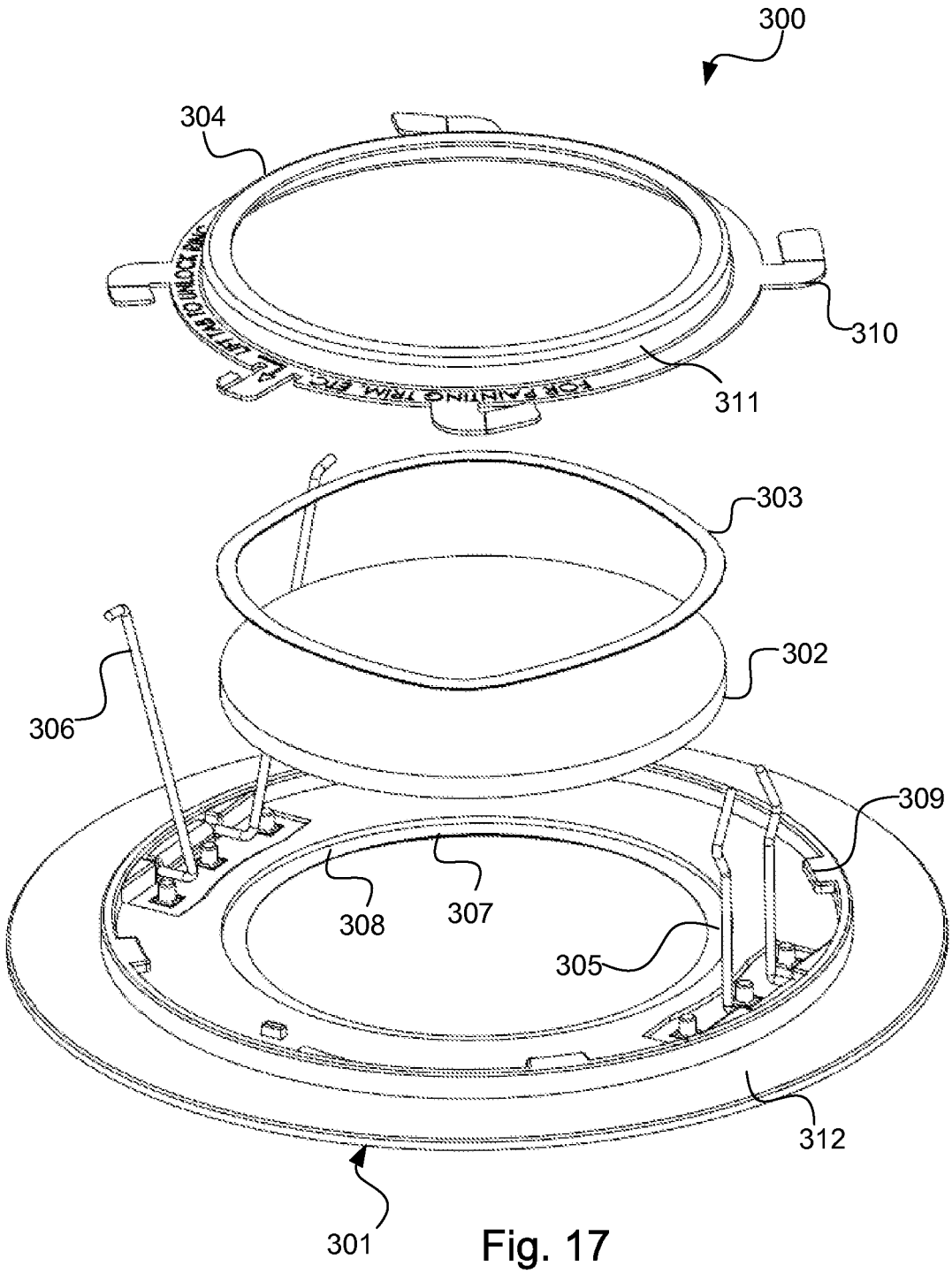
FIG. 17 illustrates an exploded view of an embodiment of a trim plate.

In an embodiment, the installation processes includes having a hole cut in the installation surface 5 and the surface being mounted over the adaptor 110 so that the adaptor 110 fits in the hole in the surface 5. As shown in FIG. 5, typically the hole will be slightly oversized so as to ensure the adaptor 110 will fit properly. As the hole may not be smooth and typically does not provide an aesthetic appearance, typically a flanged trim plate 300 would be provided that would extend out and cover the hole. For example, FIG. 17 illustrates a circular shaped flanged trim plate, however any other shape could also be provided.

To provide a potentially even more aesthetically pleasing look, as depicted in FIGS. 4 and 5, the adaptor 110 may be mudded or plastered into place (assuming the surface is suitable for such an operation). As can be appreciated, any type of material such as drywall mud, plaster or the like can be used to mud in the adaptor 110. The mud 6 (shown in dotted line) may be placed on the adaptor 110 so that it extends from a lip 114 of the adaptor 110 to the surface 5 in a substantially continuously smooth and even manner. In this manner, the luminaire 10 may be installed so as to be substantially flush with the surface. As can be appreciated, this provides a desirable finish where the luminaire 10 blends into the surface 5. If the trim plate 300 is painted the same color as the surface, than in an embodiment the only portion of the luminaire that will be visible will be the aperture medium (such as cover lens 302 in FIG. 18). However, it should be noted that the luminaire 10 is not limited to square or circular shapes, thus any other desirable shape may be used. Furthermore, as will be discussed below, any type of aperture medium, such as reflectors, baffles, filters or lens, without limitation, may be used.

As can be appreciated, however, it is somewhat difficult to orientate the housing 50 during installation so that the adaptor 110 perfectly matches the surface 5, particularly because the surface 5 is often not present so as to make installation of the housing and electrical component(s) somewhat easier. Thus, as will be discussed below, in an embodiment the housing 50, represented by support panel 55, can be installed in a manner so as to approximately align the luminaire 10. An outer sleeve 90, which may be fixably mounted to the adaptor 110, may be adjusted with respect to the support panel 55 through the use of the adjustment slots 91 so that the adaptor 110 is placed in the desired orientation once the surface 5 is in position. In other words, once the surface 5 is in position, the orientation of the adaptor 110 can be adjusted by changing the position of the outer sleeve 90. Once the adaptor 110 is correctly aligned, it may be mudded into place.

Figure 6A:
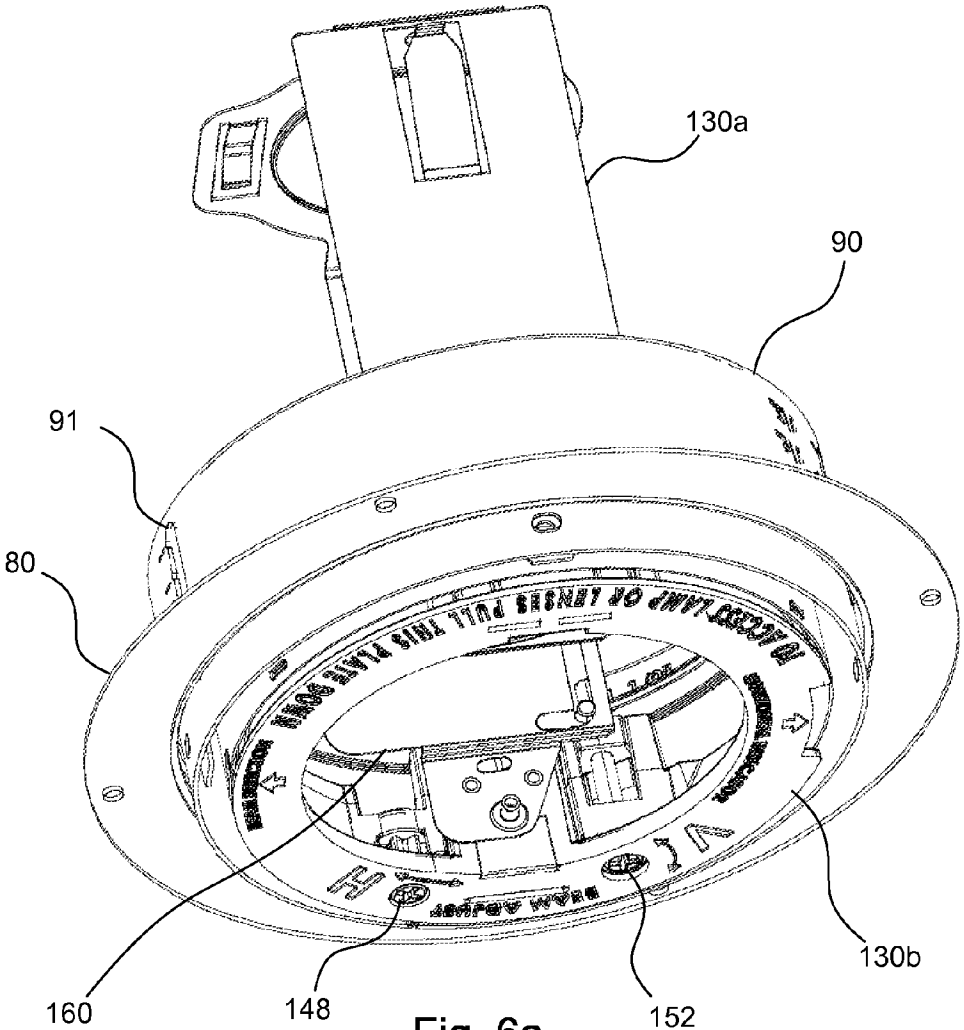
FIGS. 6*a*-10 illustrate partial isometric views of embodiments of components of an aiming mechanism that may be used in accordance with one or more aspects of the present invention.

Looking at FIG. 6, the flange support 80 may be mounted to the support panel 55 by a plurality of fasteners so as to be in a fixed position with respect to the support panel 55. The outer sleeve 90 mounts to the flange support 80 in an adjustable manner as will be discussed below. Once the outer sleeve 90 is positioned, the aiming mechanism 100 may be used to orientate the bulb 20 with respect to the outer sleeve 90 (and the adaptor 110). Thus, in an embodiment the luminaire 10 may provide a first level of adjustment with respect to the mounting surface 5 and a second level of adjustment with respect to the orientation of the bulb 20.

As depicted, and as will be discussed in greater detail below, the angular orientation of the tray system 160 may be adjusted by rotating a member 152. Simultaneously, the rotational orientation of the tray system 160 may be adjusted by rotating a member 148. It should be noted that any type of interface, such as an Allen wrench, a star driver or a conventional screw head may be used as appropriate. Thus, by rotating the members 148 and 152, an orientation of a bulb (which can be supported by the tray system 160) can be changed. As can be appreciated, the depicted configuration allows the angular and rotational orientation of the bulb to be adjusted while it is in operation. While not required, this is advantageous because the person attempting to aim the bulb receives visible feedback as to whether the bulb is correctly aimed without the need to reassemble or even turn the bulb on first. As depicted, the vertical (or angular orientation) and the horizontal (or rotational orientation) are plainly marked so as to facilitate ease of adjustment, however some other type of marking may be used as desired.

It should be noted that lower section 130*b* and upper section 130*a*, which are two parts of aiming frame 130 (FIG. 9), are fastened together and may be pulled down so that the tray system 160 is accessible. In this manner, the bulb 20 may be readily replaced. In an embodiment, as depicted, the lower section 130*b* may include instructions, which may be placed on the lower section 130*b* in a known manner, indicating that the lower section 130*b* can be pulled down.

Figure 7:
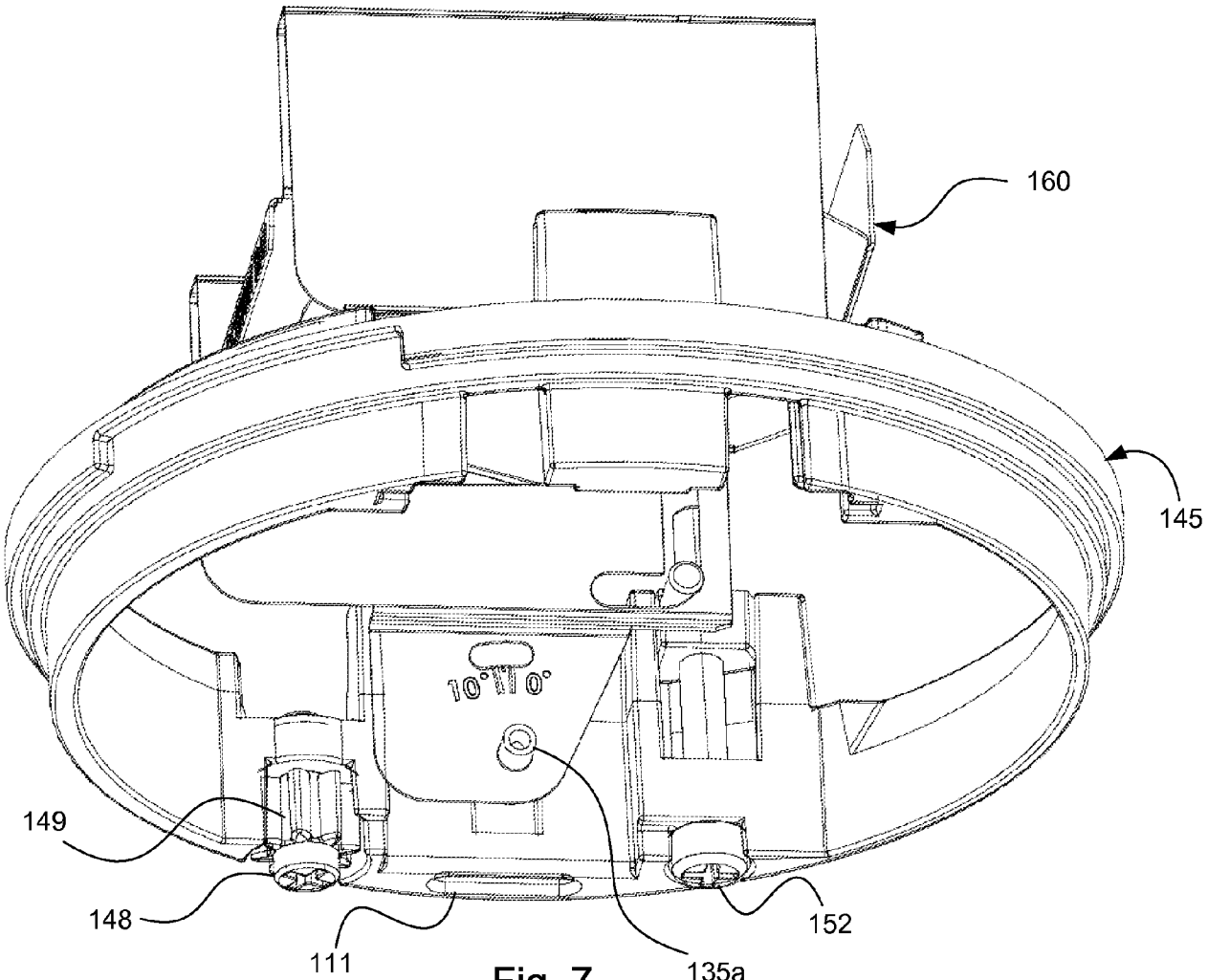
Figure 8:
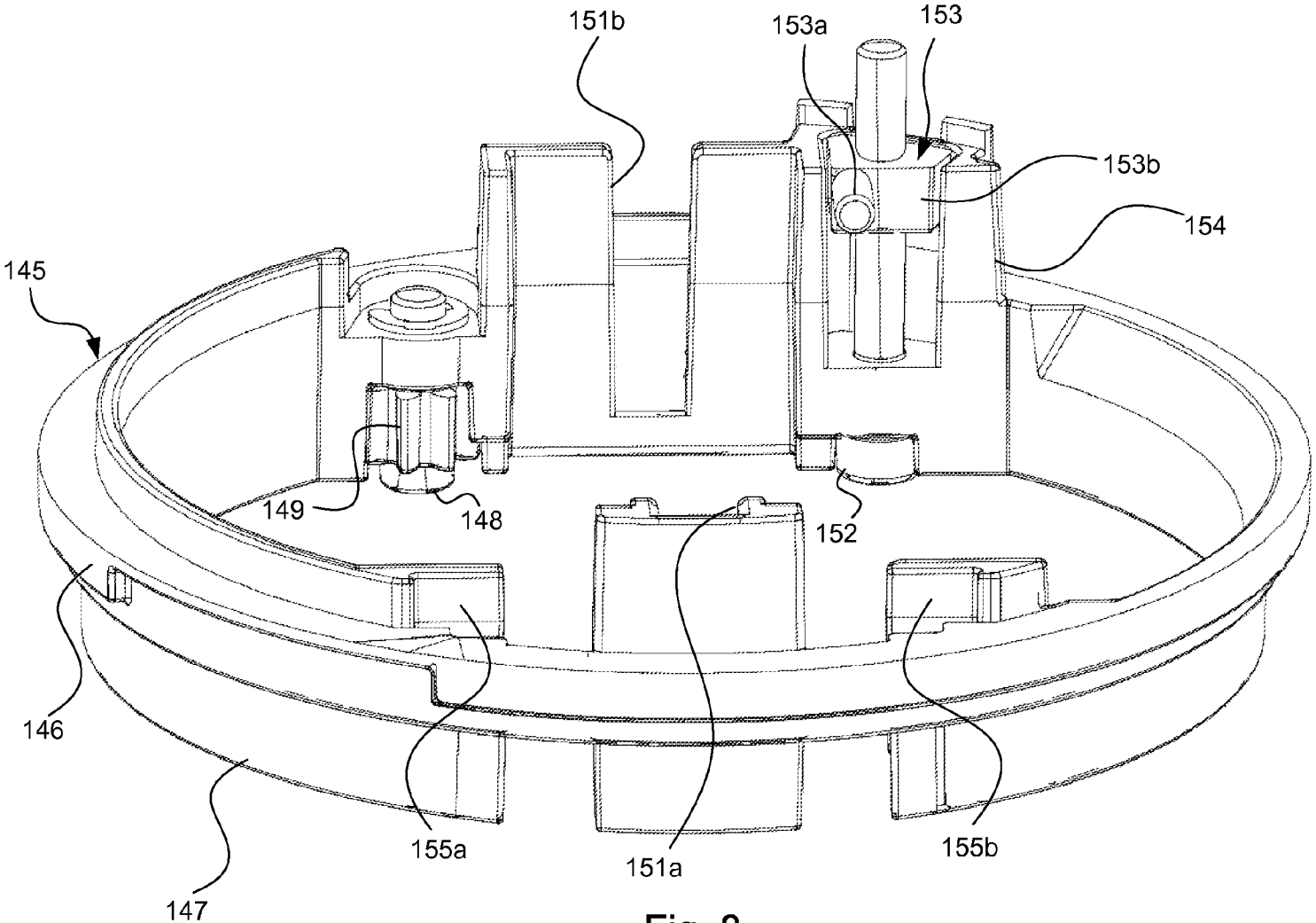
Figure 20A:
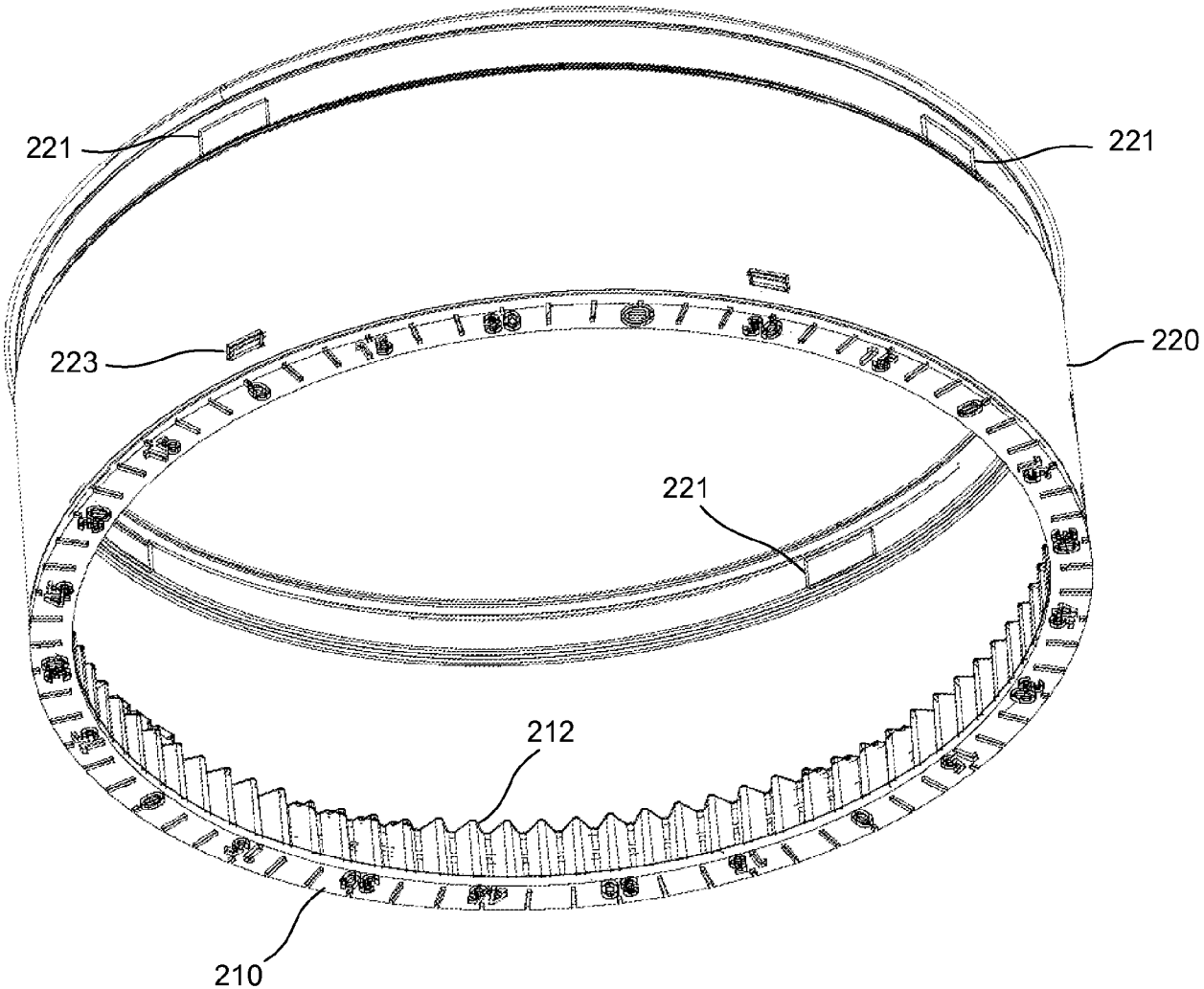
FIG. 20*a* illustrates an isometric view of an embodiment of an inner sleeve and ring gear.

As can be appreciated from FIGS. 7 and 8, the member 148 is coupled to a pinion 149. In operation, turning of the member 148 causes the pinion 149 to rotate and because the pinion 149 is in contact with teeth 212 of a ring gear 210 (FIG. 20), the rotation of the pinion 149 causes the orientation ring 145 to rotate with respect to the ring gear 210. Thus, the member 148, the pinion 149 and the ring gear 210 are an example of a rotation drive. It should be noted that to help maintain stability and prevent inadvertent rotation adjustment, an O-ring, wavy washer, or some other friction increasing element may be used to prevent the pinion from rotating except when a sufficient rotational force is exerted on the member 148. A shoulder of the orientation ring 145, such as a portion of shoulder 146, rests on the top of the teeth 212 and therefore the orientation ring 145 may be readily rotated. It should be noted that, while not required, the orientation ring 145 may be configured so that it can only rotate through a range of slightly more than 360 degrees (180.5 degrees from center in both directions, for example). As can be appreciated, the ability to rotate the orientation ring 145 slightly over 360 degrees in total prevents the occurrence of dead spots while minimizing the undesirable twisting of any wires that are attached to the bulb 20. It should be noted that if a rotation limit feature is provided, it may be beneficial to provide some audible or tactile feedback such as a click or snap to the user so as to indicate that the stop has been reached so that the user does not continue to try to rotate the orientation ring 145 and potentially damage internal components.

Figure 23A:
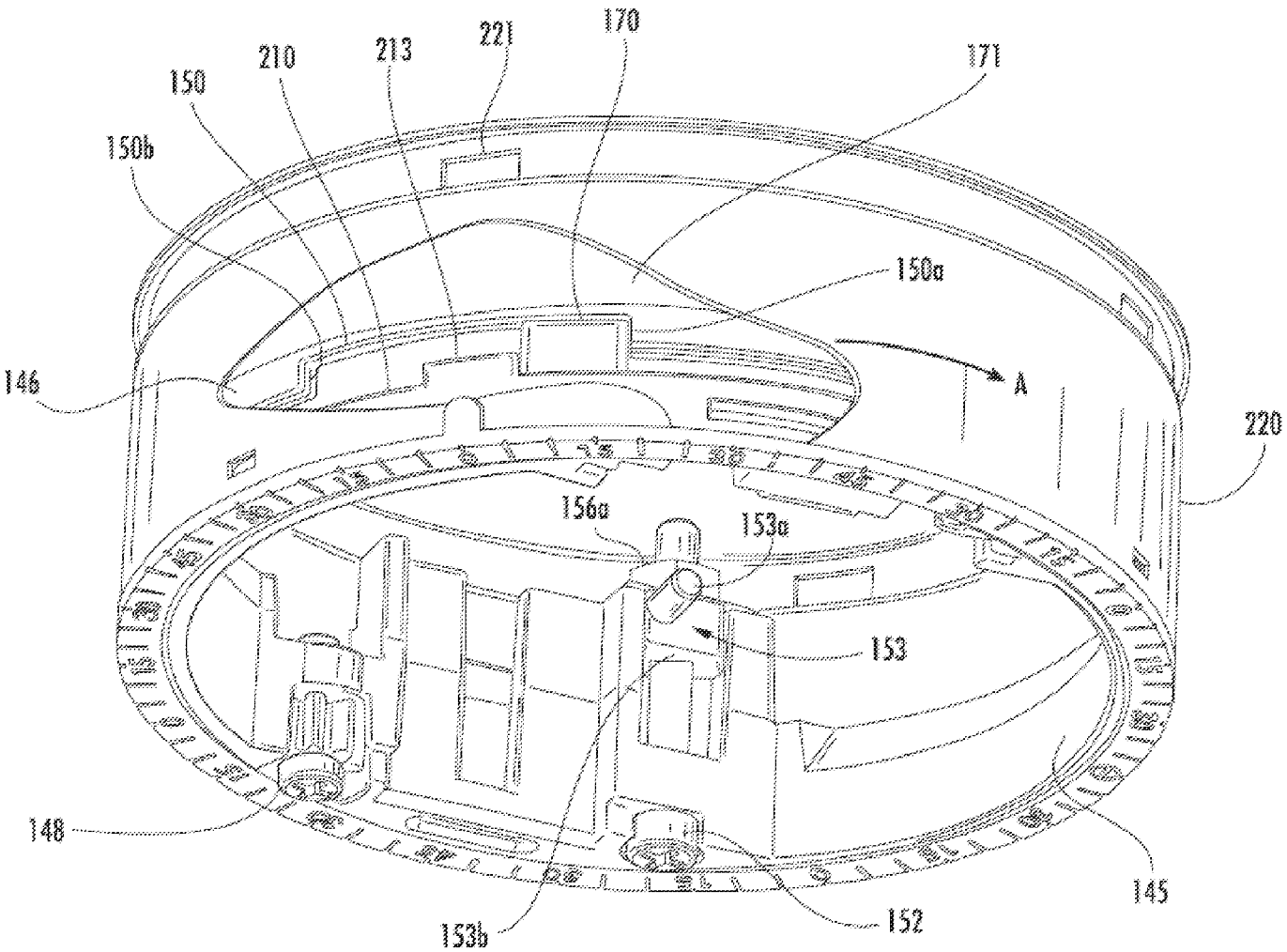
FIG. 23*a* illustrates a cut-away isometric view of an embodiment of an outer sleeve and an orientation ring.
Figure 23B:
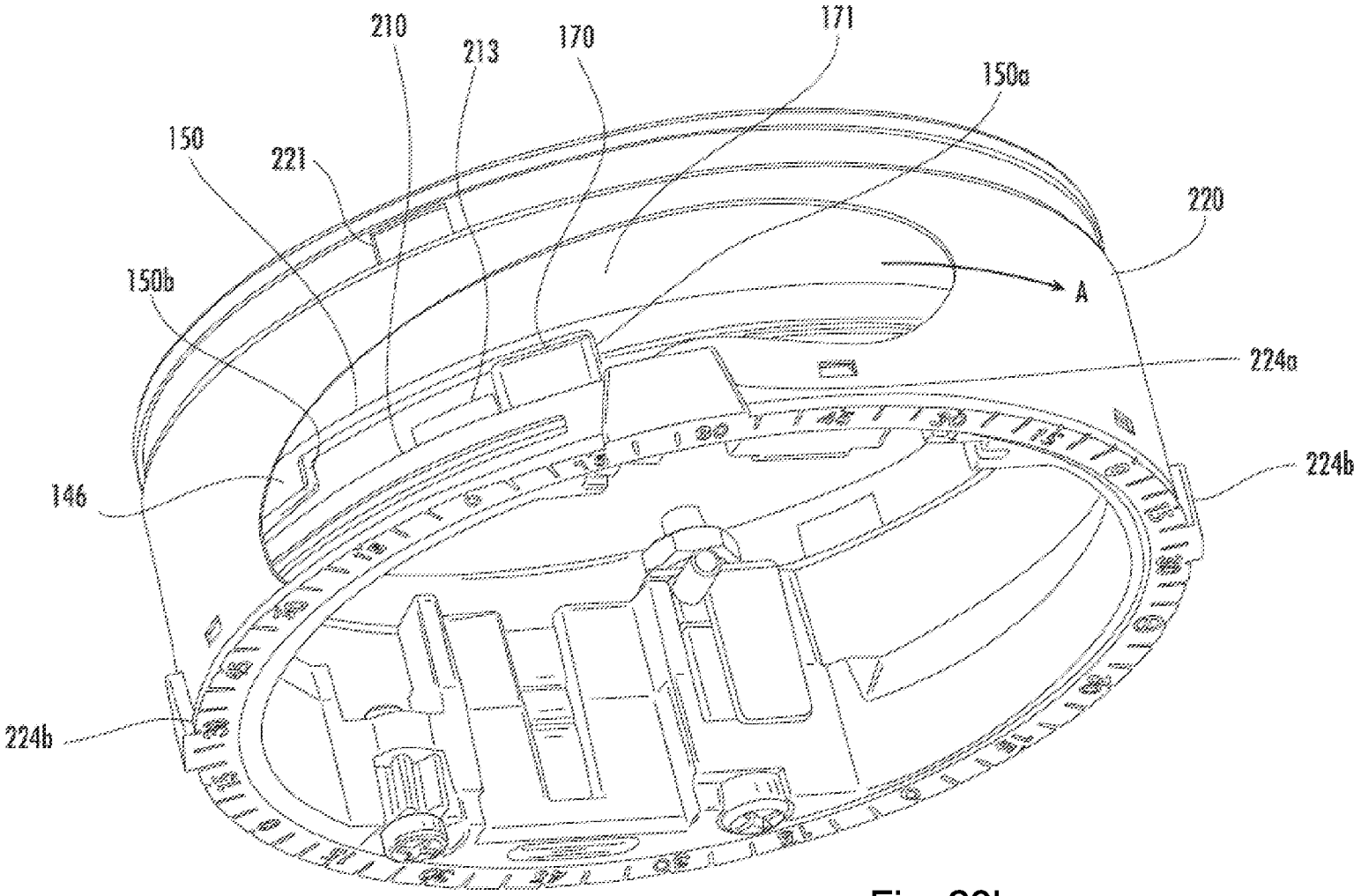
FIG. 23*b* illustrates a cut-away isometric view of another embodiment of an outer sleeve and an orientation ring.

FIGS. 23*a* and 23*b* illustrate embodiments of how a limited over-center rotation may be provided. As depicted, a cut-out has been made in the inner sleeve 220 so as to better show the interaction between components. Rotation of the member 148 causes the orientation ring 145 to rotate with respect to the ring gear 210 (which may be configured as depicted in FIG. 20). The shoulder 146 is configured so as to allow the shoulder 146 to rotate without contacting a finger 213 of the ring gear 210. A sliding member 170 is positioned between the orientation ring 145 and the ring gear 210 in a cutout 150. The sliding member is thus positioned between the orientation ring 145, the ring gear 210 and the inner sleeve 220. When the orientation ring 145 is rotated more than 360 degrees in direction A, the sliding member will go from being sandwiched between the finger 213 and the edge 150*a* to being sandwiched between the finger 213 and the edge 150*b*. A spacing ring 171 may be provided above the orientation ring 145 so as to prevent the orientation ring 145 from being pushed up. This may be helpful, for example, when the member 148 or member 152 is being rotated.

Because the tray system 160 is supported by the orientation ring 145, when the orientation ring 145 rotates, the tray system 160 also rotates, thus rotation of the orientation ring 145 also rotates the bulb 20. However, the tray system 160 is pivotally mounted to the orientation ring 145 by fastener 135*a* (and 135*b*). Therefore, rotation of the member 152, which may include external threads that engage internal threads of the orientation block 153 so that the member 152 functions like a worm drive, will cause orientation block 153 to move up and down. And because orientation block 153, which includes arm 153*a* and base 153*b*, is coupled to the tray system 160, up and down movement of the orientation block 153 causes the tray system 160 to pivot about the fastener 135*a*. Thus, the member 152 and the orientation block 153 are examples of a tray drive. The threads on the member 152 may be acme threads so as to help prevent to orientation block 153 from moving except when a rotation force is exerted on the member 152. It should be noted that, depending on the configuration of the tray system 160 and the tray drive, the orientation of the tray system 160 may be capable of rotating through a range of 45 degrees from straight up and down, or even more. For example, the ability to rotate 45 degrees allows greater flexibility in the location of the luminaire with respect to the desired focus point of the bulb. However, as can be appreciated, at some point greater angles of angular orientation are limited by the size of the aperture and the distance above the aperture (because the surface 5 will typically act as a limiting factor, even if the luminaire is mechanically capable of greater ranges of angular adjustment).

Figure 18:
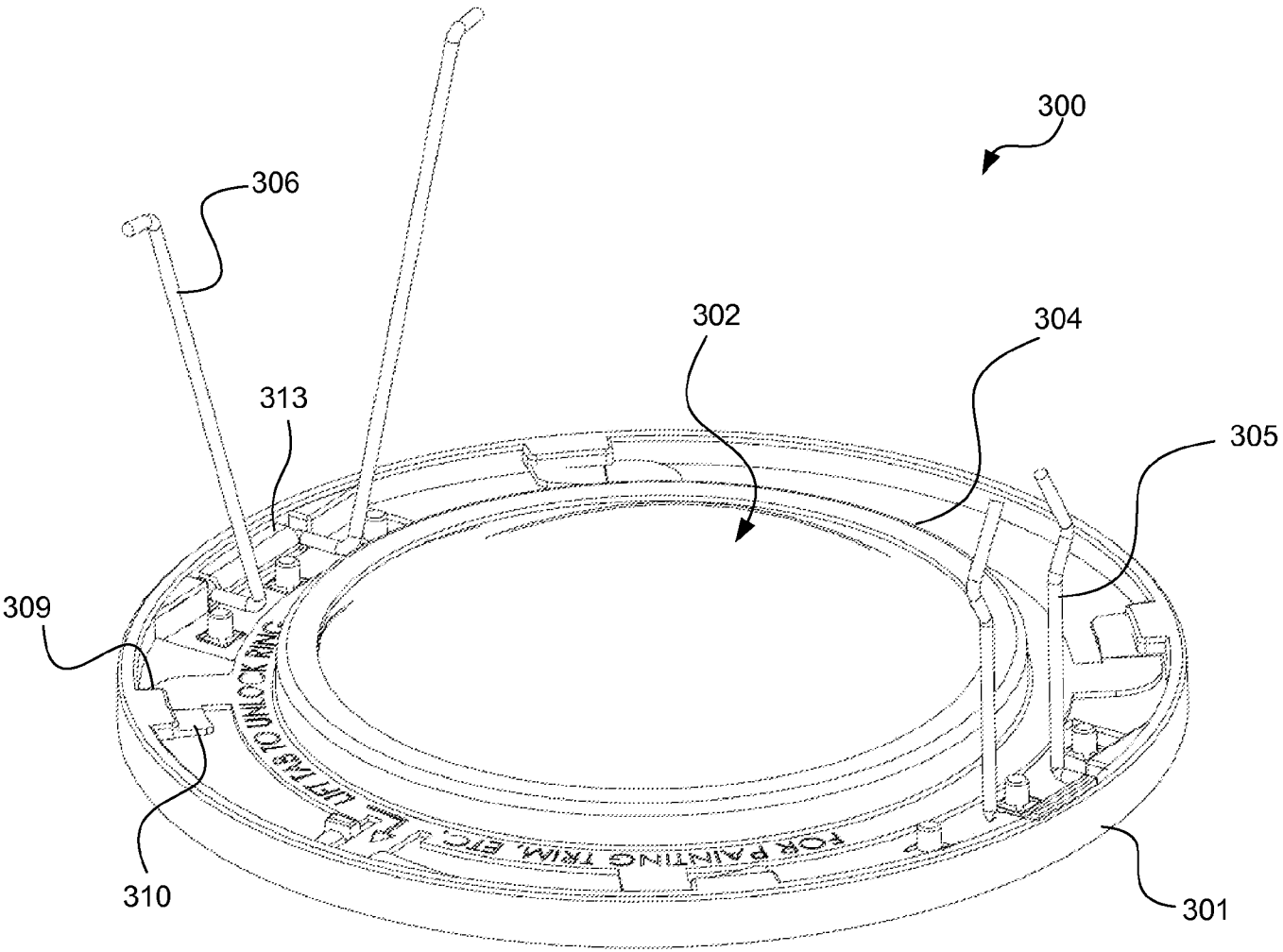
FIG. 18 illustrates an isometric view of an embodiment of trim plate without a flange.

The orientation ring 145, as depicted, includes a flange 147 that fits inside of the teeth 212 of the ring gear 210. In addition, for a circular cover, such as depicted in FIGS. 17 and 18, retaining features 155*a* and 155*b* are configured to accept spring retainer 306 while slot 111 is configured to accept spring retainer 305. Channels 151*a* and 151*b* are configured to engage retaining arms 131 of the upper section 130*a* when the aiming system 100 in inserted into the housing 50.

Figure 9:
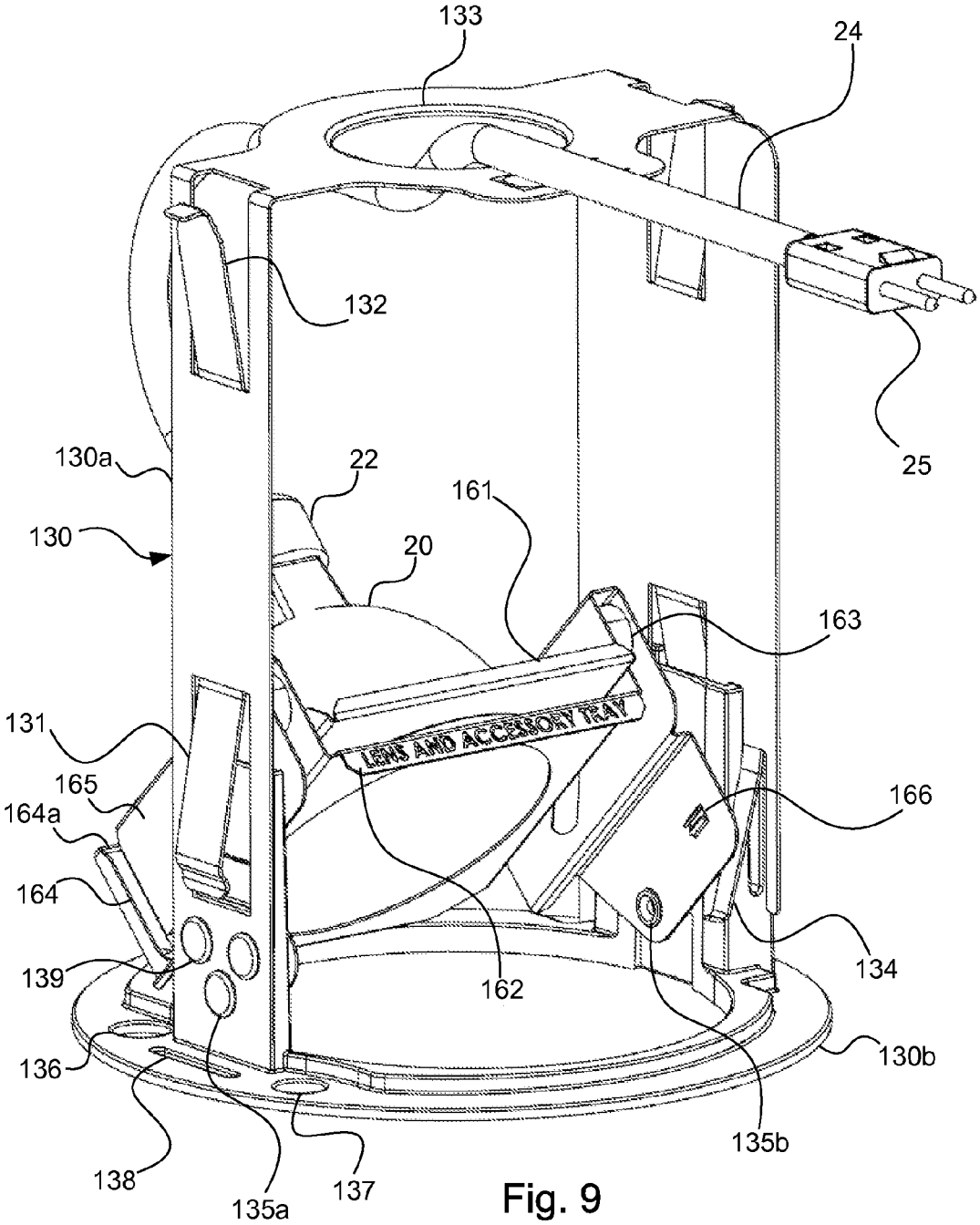
Figure 10:
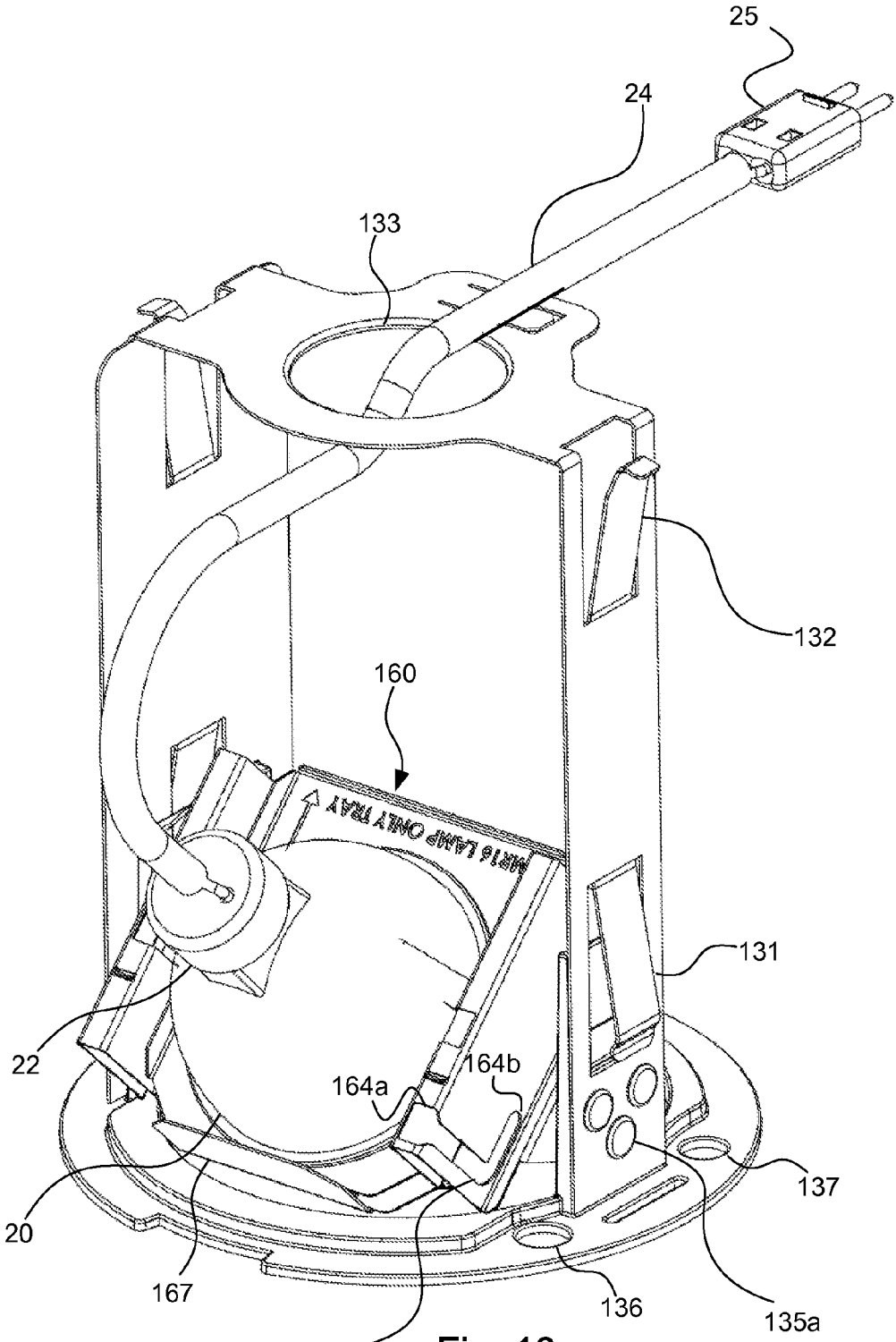
Figure 14:
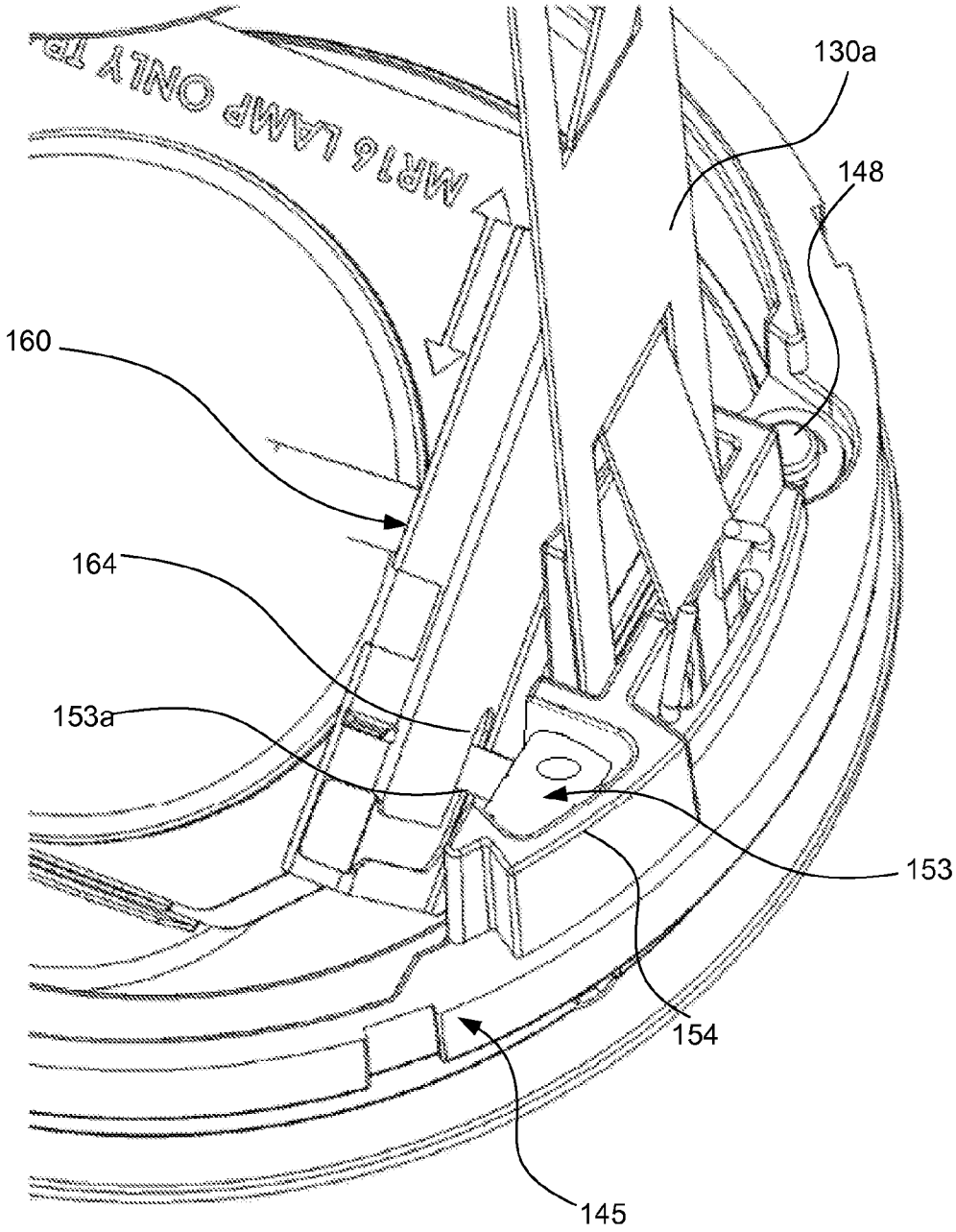
Figure 15:
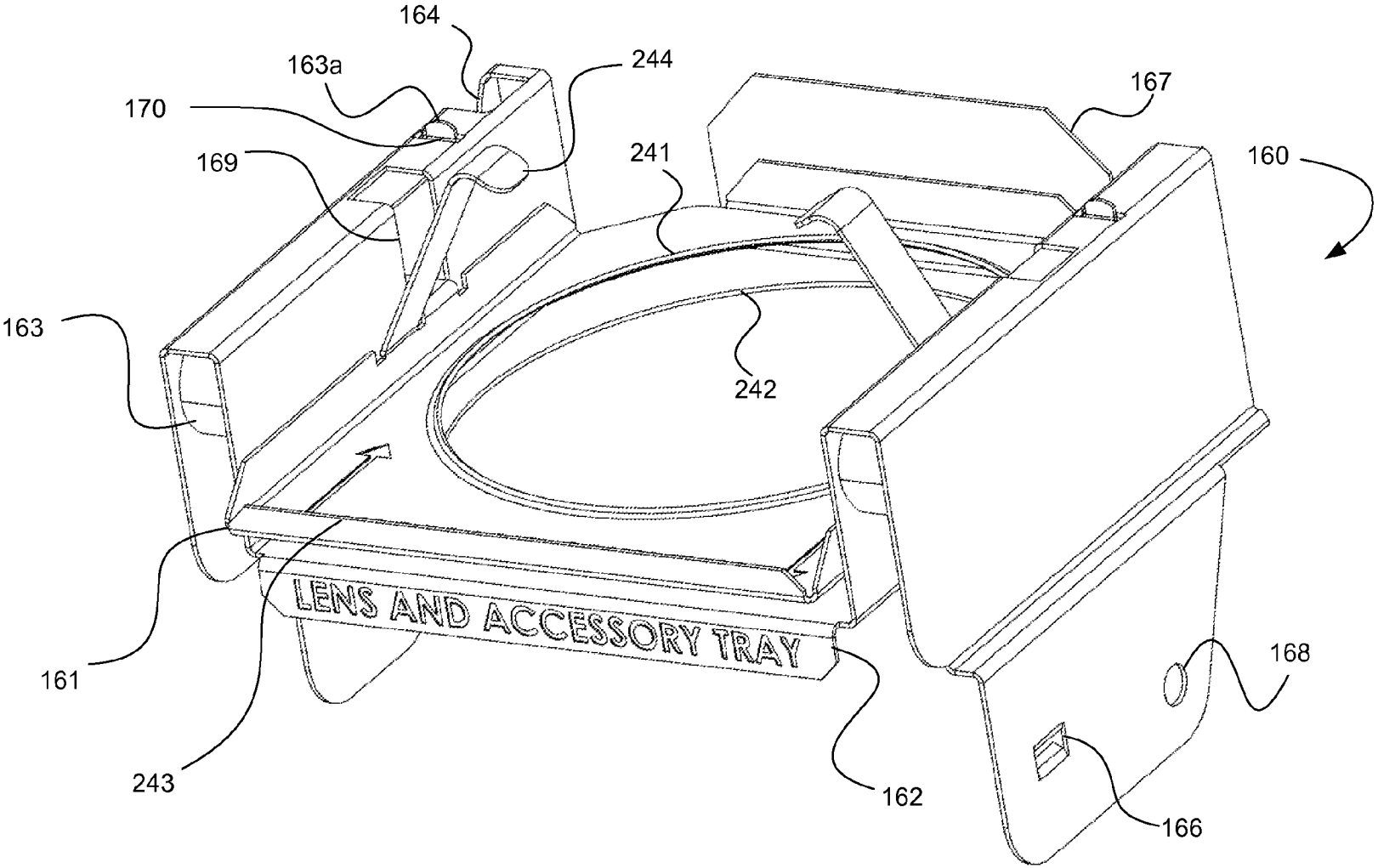

The tray system 160, as depicted in FIGS. 9 and 10, includes an upper tray 161 and a lower tray 162 that supports the upper tray 161. These upper and lower trays 161, 162 are urged together by biasing elements 163, as illustrated in FIGS. 14 and 15 and the bulb 20 is supported by the upper tray 161. The lower tray 162 includes an L-shaped channel 164 with an opening 164*a* and an end 164*b*. The depicted tray system 160 is pivotally mounted to the aiming frame 130 via fasteners 135*a* and 135*b*.

The aiming frame 130, as depicted, includes the upper section 130*a* and the lower section 130*b* coupled together by fasteners 139. The lower section 130*b* includes access holes 136 and 137 so as to provide access to the members 148 and 152. The upper section 130*a* includes opposing retaining arms 131, which are configured to engage the channels 151*a* and 151*b* of the orientation ring 145. When the aiming frame 130 is pulled down, the opposing restraining arms 132, which also engage the channels 151*a* and 151*b*, prevent the aiming frame 130 from falling out of the luminaire. In other words, when pulled down, the aiming system 100 hangs from the orientation ring 145 by the restraining arms 132 and when pushed back up, is held in position by the retaining arms 131.

As depicted, the upper section 130*a* includes a wire hole 133. This allows the wire that is attached to the bulb 20 to avoid being caught by the aiming mechanism while the aiming mechanism is being lowered and raised. In an embodiment, the wire hole 133 will have a smooth edge so as to minimize the possibility of damage to the wire 24.

The wire 24 is shown coupled to the bulb 20 via connector 22 and includes another connector 25. It should be noted that after repeated bulb changes, the connector 22 may become worn. Thus, the connector 25 allows for ready replacement of the connector 22 without the need to splice a new connector into the wire 24. The connector 25, in turn, mates with another connector, not shown, that is mounted on a wire that extends from the transformer 250 via a path that may include the tube 274.

Figure 12:
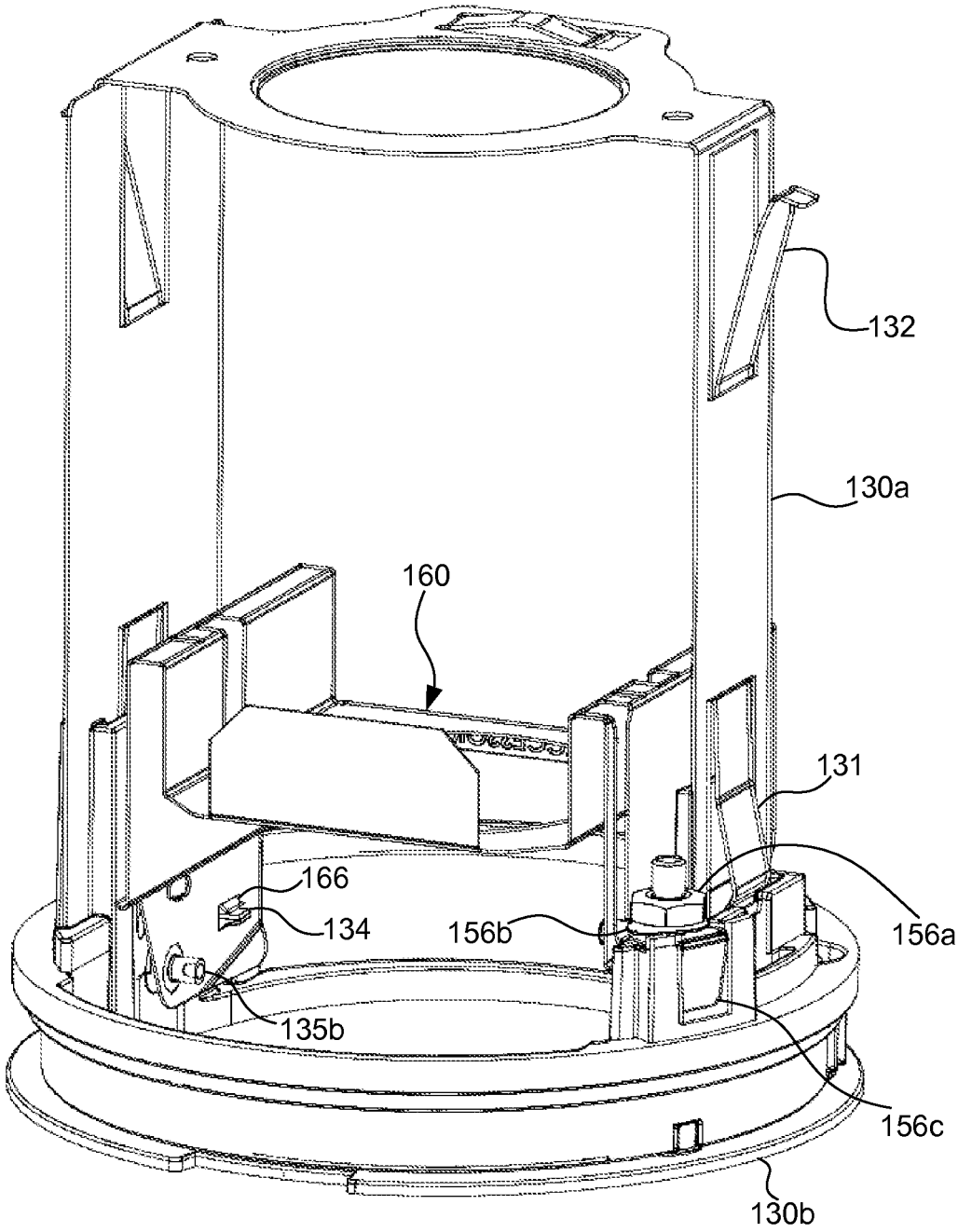
FIGS. 12-15 illustrate partial isometric views of embodiments of components of an aiming mechanism of a luminaire.

As can be appreciated, the upper section further includes locking arm 134. When the aiming frame 130 is fully inserted into the housing 50, the locking arm 134 is pushed out of the way by the orientation ring 145. However, when the aiming frame 130 is pulled down, the locking arm 134 is allowed to move into a locking position. During the pulling down of the aiming frame 130, the tray system 160 will be forced into a first (or true vertical) position by the interaction of the orientation block 153 and the channel 164, as will be discussed. When in this position, the locking arm 134 will engage locking feature 166 on the tray 160, as illustrated in FIG. 12. Thus, the orientation of the tray system 160 will be returned to the first position when the aiming frame 130 is pulled down so that the tray system 160 (and the bulb, if present) can be accessed. However, when the aiming frame 130 is reinserted into the housing 50, the locking arm 134 will be pushed back by the orientation ring 145 so that it ceases to engage the locking feature 166 and the tray system 160 will return to its previous angular setting.

While such a system of returning the tray system 160 to a first position during bulb and/or lens change is not required, it provides an advantage. As can be appreciated, the footprint of the tray system 160 is greater when the tray system 160 is at some angular orientation other than when in the first position. Therefore, to pull down the tray system 160 while at some position other than the first position would require greater clearance and thus the clearance around the bulb 20 would need to be greater. In particular, to avoid the need for resetting the aim of the bulb 20, the clearance would have to satisfy the worst case scenario and thus the opening through which the bulb 20 transmitted light would be greater than otherwise needed. This would provide a potentially less aesthetic appearance when the luminaire 10 was installed.

Figure 11:
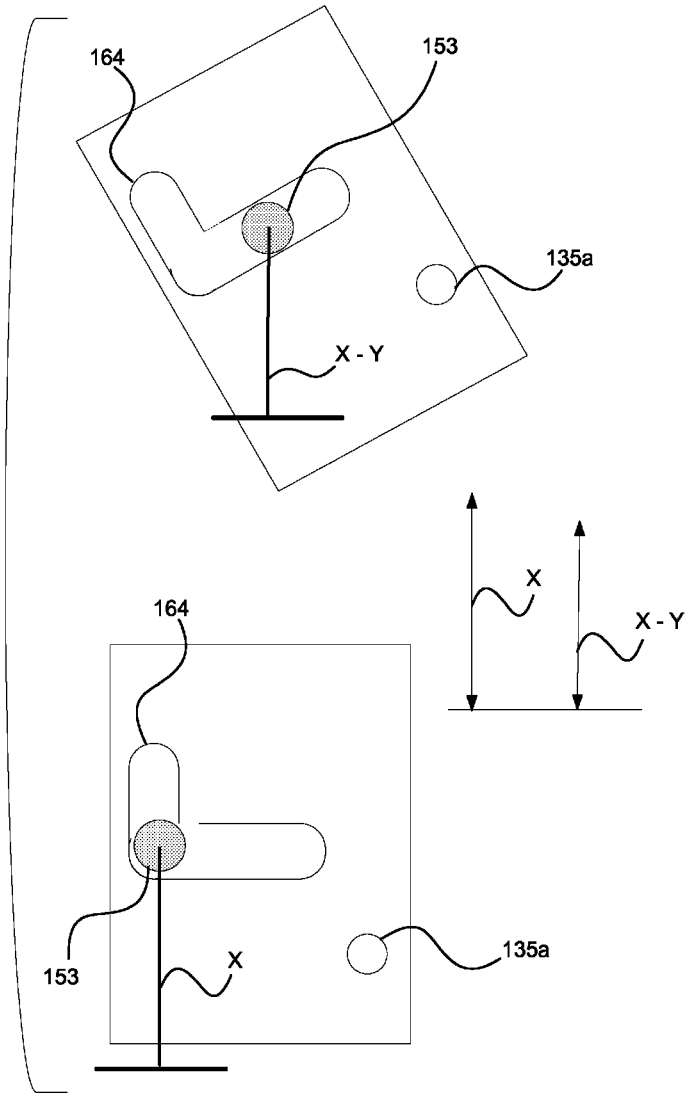
FIG. 11 illustrates schematic representation of a change in orientation of a tray system in accordance with one or more aspects of the present invention.

FIG. 11 provides a schematic illustration of how the angular orientation of the tray system 160 depicted in FIG. 10 is adjusted. When the tray system 160 is in the first position, the orientation block 153 is in an up or first position and the distance between a point on the orientation ring 145 and the orientation block 153 is X. However, when the orientation block 153 is lowered by distance Y, the distance between the orientation block 153 and the point on the orientation ring 145 is X minus Y and the orientation of the channel 164, which is slidably coupled to the arm 153*a*, causes the tray system 160 to pivot about the fastener 135*a* and the arm 153*a* slides along the channel 164 toward the end 164*b*. When the aiming frame 130 is pulled down, however, the pivot point 135*a* is pulled down and this causes the orientation of the tray system 160 to return to the first position so that the arm 153*a* can slide up the channel 164 and out the opening 164*a*.

To hold the member 152 in place, a nut 156*a* (FIG. 12), which may be a lock-nut or may be held in position via some known means of resisting loosening, is mounted on the member 152. A washer 156*b* is provided and slides relative to an anti-rotation tab 156*c*, which may be spring tempered and may rest on the orientation ring 145. Thus, the member 152 is held in position but allowed to turn without the need for excessive force to overcome any friction associated with the movement of the orientation block 153.

Figure 13:
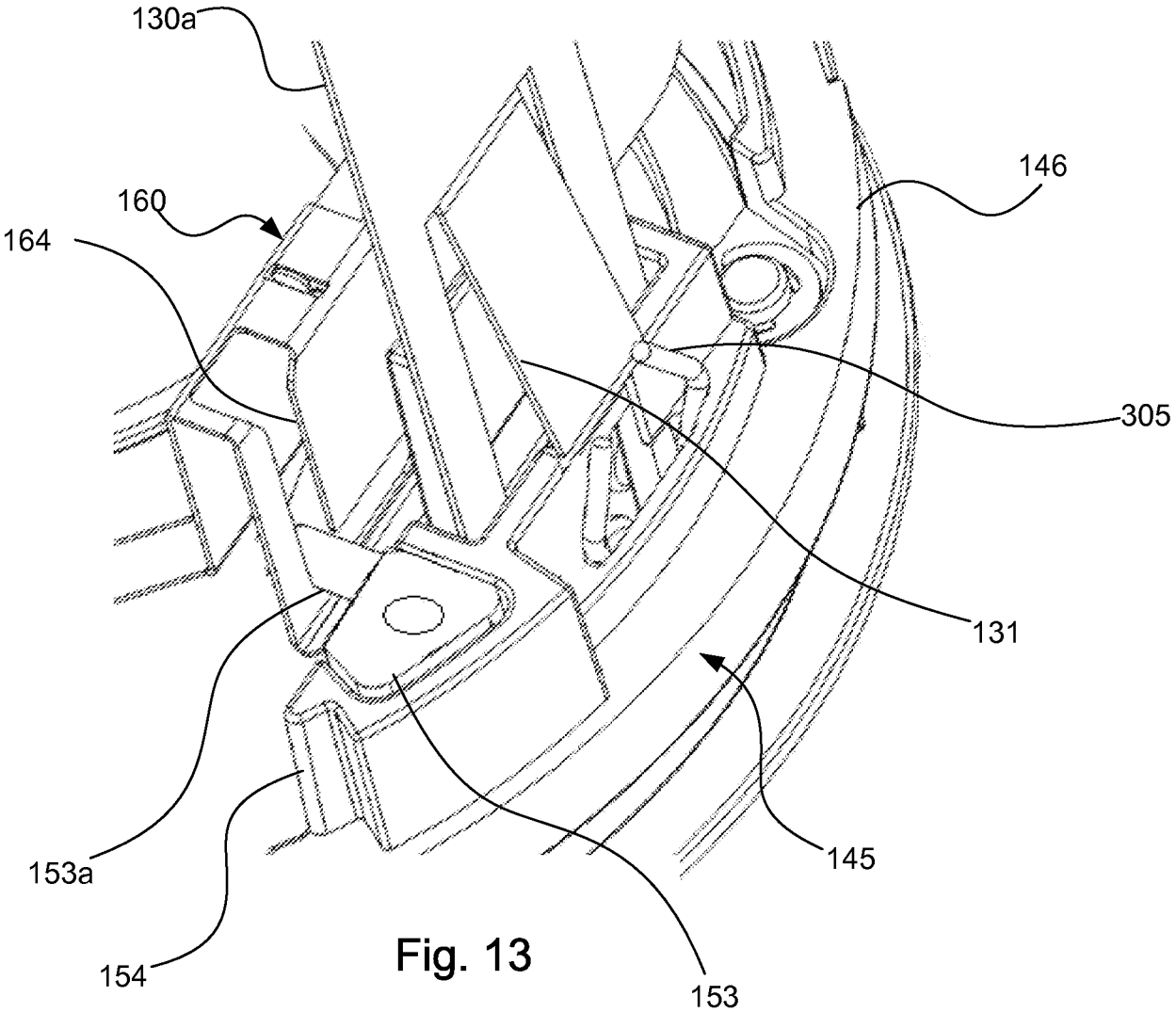

FIGS. 13 and 14 illustrate a partial view of the orientation block 153 and tray system 160 as the orientation block and the tray moves from the first position as shown in FIG. 13 to a second position in FIG. 14. As discussed, the orientation block 153, which slides in a channel formed by portion 154, may move to a second position that causes the tray system 160 to move to a second position but if the aiming frame 130 is pulled down, the tray system 160 will return to the first position while the orientation block 153 remains in a second position. Thus, when the orientation block 153 is lowered, the tray system 160 is tilted. Thus, the angular orientation of the bulb 20, which rests on the tray system 160, can be adjusted as desired.

As can be appreciated from FIGS. 13 and 14, the retaining arms 305 (which are attached to the trim plate 300), engage a channel in the orientation ring 145. Thus, the angular orientation of the trim plate 300 corresponds to the angular orientation of the orientation ring. Such a configuration is suitable for a circular shaped trim plate 300; however, as will be discussed below, such a configuration may not work with a non-circular shaped trim plate 300 if the ability to rotate the tray system 160 is desired.

Figure 16:
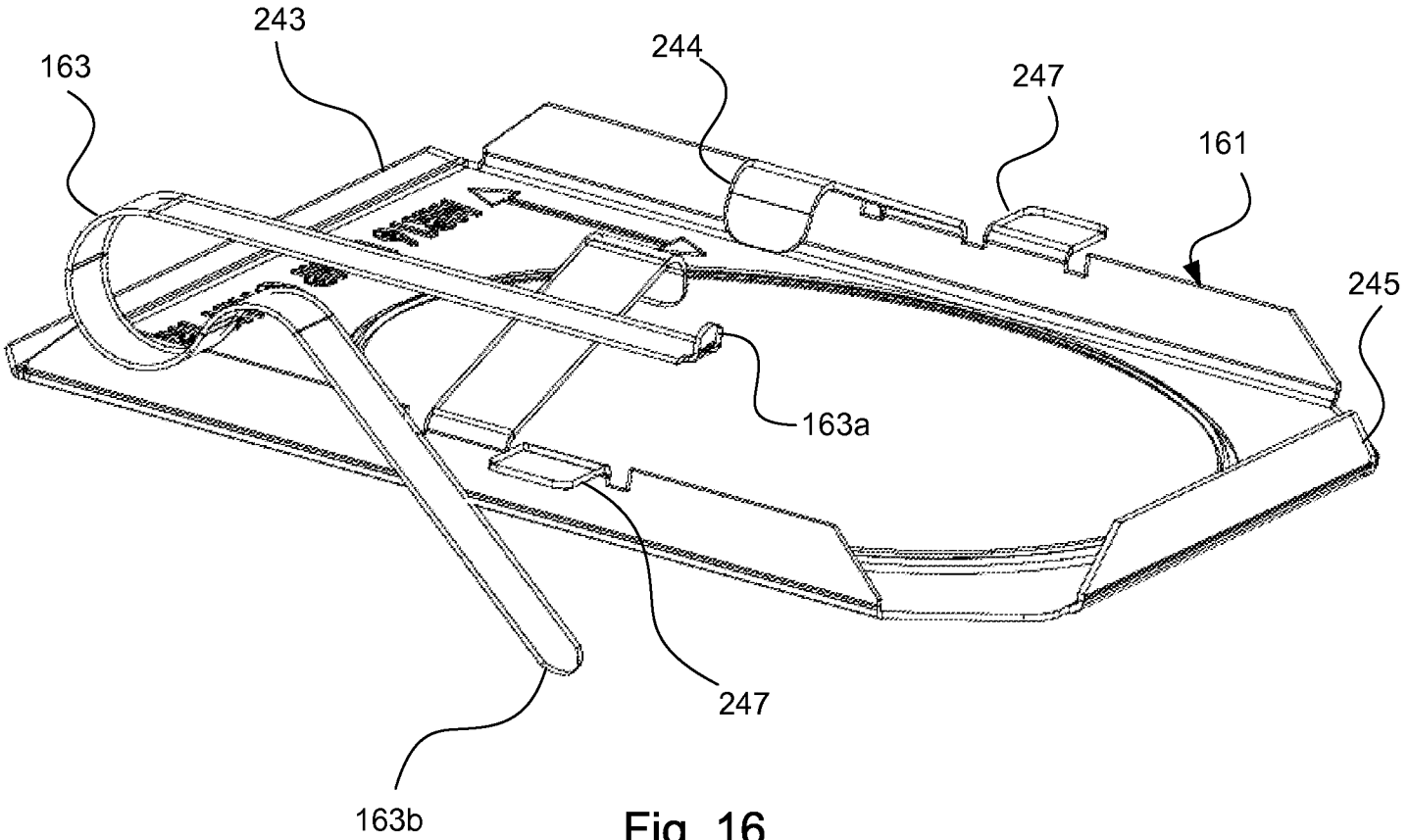
FIG. 16 illustrates a partial exploded view of an embodiment of a tray system.

Turning to FIGS. 15 and 16, additional details of an embodiment of a tray system 160 are illustrated. As depicted, the upper tray 161 is configured to accept a MR16 bulb. While other types of bulbs may be used if the luminaire 10 is appropriately configured, the MR16 bulb provides a desirable color output and can be used to create patterns due to its focused beam and therefore is a popular choice among interior decorators, designers and architects. In operation, the bulb is placed on the upper tray 161 and held between lips 243 and 245 by bulb arms 244. The light from the bulb is directed through opening 241 and opening 242.

To provide greater customization, lenses and accessories, such as grids and colorization filters, may be used in combination with the bulb. In operation, the upper tray 161 may be raised and various lenses and accessories may be inserted between the upper tray 161 and the lower tray 162. To hold the lenses and accessories in position between the upper tray 161 and the lower tray 162, tabs 247 of the upper tray 161 slide in channels 169 of the lower tray 162. Biasing elements 163 act to urge the upper tray 161 toward the lower tray 162, thus holding the lenses and/or accessories that are placed between the upper tray 161 and lower tray 162 in a stationary position. A back wall 167 may be provided to act as a stop for inserted lenses and accessories.

As depicted, the biasing element 163 is a leaf spring with a first end 163*a* that engages a notch 170 in the lower tray 162. A portion of the biasing element 163 near a second end 163*b* presses on the tab 247 and urges it downward. As can be appreciated, an advantage of the depicted design is that it is simple to assemble and manufacture while providing desirable control of any lenses positioned between the upper and lower trays 161, 162. Furthermore, changing of the bulb 20 does not disturb the orientation of the lenses or accessories positioned between the upper and lower tray 161, 162, thus preserving the effort and time spent orientating any such lenses and/or accessories in the first place. It should be noted, however, that other configurations of biasing elements may be used to urge the upper tray 161 and the lower tray 162 together. For example, a plurality of coiled springs (such as three coiled springs positioned, for example, on three sides of the tray system 160) could also be used if desired. Naturally, any other desirable configuration of biasing elements (that either pulls or pushes) may be used to urge the upper tray 161 and the lower tray 162 together.

As can be appreciated, however, if the ability to set the orientation of lenses and accessories separate from the bulb is not desired, then the bulb arms 244 can be built directly into the lower tray 162 and the upper tray 161 may be omitted. In such a configuration, the tray system 160 would still allow for changing the bulb 20 without disturbing the angular or rotation orientation of the bulb but the changing of the bulb could potentially disturb any lenses or accessories placed directly on the tray below the bulb 20.

It should be noted that the upper tray 161 may be configured to work with a particular sized bulb. If it is desired to use a different sized bulb that is not compatible with the bulb arms 244 of the upper tray 161, the upper tray 161 can readily be replaced. Thus, certain embodiments of the present invention provide for significant flexibility in dealing with future bulb designs.

Turning now to FIG. 17, an exemplary exploded view of embodiment of a trim plate 300 is illustrated, the trim plate 300 being a flanged trim plate design intended to cover the opening around the light fixture rather than rest in an adaptor 110 that is mudded into place. While the mudded adaptor design provides a clean look when installed, such an installation is not always desired and is generally incompatible with certain surfaces such as a ceiling tile that is commonly used in a drop ceiling.

The trim plate 300 includes a lower plate 301, a cover lens 302 (which is an example of an aperture medium), an undulating washer 303 and a retaining bracket 304. In operation, the retaining bracket 304, in cooperation with the undulating washer 303 presses the cover lens 302 against the lower plate 301. Tabs 309 on the lower plate 301 are configured to engage angled tabs 310 on the retaining bracket 304 and the tension caused by rotating the retaining bracket 304 so as to insert the angled tabs 310 beneath the tabs 309 allows the retaining bracket 304 to securely hold the cover lens 302 in position. It should be noted that numerous other configurations of the lower plate 301 and the retaining bracket 304 are possible. In general, the lower plate 301 and retaining bracket 304 may be configured to accept any shape of aperture medium that is desired to be used. However, in an embodiment, the retaining bracket 304 can be configured to hold the aperture medium to the lower plate 301 in a removable manner so that the retaining bracket 304 may be removed without the need for tools. This allows the user to quickly replace the aperture medium and potentially makes it easier to do so because the user does not need to hold a tool (which can be problematic if the user is standing on a step of a ladder and trying to maintain the user's balance while performing the aperture medium change). Naturally, depending on the configuration of the aperture medium, the undulating washer 303 may be omitted.

In an embodiment, the lower plate 301 can be painted to match the ceiling surface. If this is desired, then the retaining bracket 304 and cover lens 302 can be removed so that the painting operation does not accidentally mark the cover lens 302.

While it may be desirable to remove the aperture medium, the retaining arms typically do not need to be removed. Therefore, as depicted, the retaining arms 306 and 305 may secured to the lower plate via clips 313*a* and 313*b*, respectively, which are in turn press-fit onto posts 314 of the lower plate 301. Naturally, any other suitable fastening means, such as adhesives, screws, welds, staking and the like, may also be used to secure the retaining arms 305, 306 to the lower plate 301, depending on the materials being used for the various components.

To install the trim plate 300, the retaining arms 306 are compressed together and inserted into the fixture so as to engage the retaining features 155*a* and 155*b*. Because the retaining arms 306 are pivotally mounted to the lower plate 301, when the trim plate 300 is pulled down so that the adjustment features or the bulb can be accessed, the trim plate 300 can hang out of the way in an attached but uninstalled position, dangling by the retaining arms 306, which will be securely engaged in the retaining features 155*a* and 155*b*. This allows the operator the ability to readily make any desired adjustments without having to worry about dropping or storing the cover while making the adjustments. As can be appreciated, this feature potentially frees up one of the operator's hands and thus has the potential to make the adjustment process safer for the operator.

To install the trim plate 300, the trim plate 300 is pivoted back so as to be aligned with the surface and the retaining arms 305 are inserted into the slot 111 formed in the orientation ring 145. This also pushes the retaining arms 306 into the fixture and the angled nature of the arms urges the trim plate 300 to stay in the installed position. Thus, the combination of the two sets of retaining arms 305, 306 holds the trim plate 300 in place. Accordingly, the trim plate 300 can be removed from a first installed position to a second uninstalled position, an adjustment made, and then the trim plate 300 moved back to the installed position. Thus, the depicted embodiment provides a mechanism for making changes to the orientation (or even changing the bulb) in a safer and more timely manner than previously available.

Regarding the materials being used for these and other components of the luminaire 10, any suitable alloys such as steel or aluminum alloys may be used and the components may be painted or coated in a desirable fashion, depending on manufacturing limitations and costs. In addition, plastics and other materials such as ceramics and the like may be used as desired. Furthermore, any desirable manufacturing process may be used and the components may be die-cast, extruded, stamped or machined as desired, depending on the desired material properties, the number of pieces desired to be used and the cost structure and manufacturing processes available. Thus, while it is envisioned that many of the components may be produced via a stamping process, any other desirable process may be used. Furthermore, unless otherwise noted, one or more of components depicted as a separate component may be integrated with other components so as to reduce the number of parts that make up the luminaire 10. For example, the flange support 80 and the support panel 55 could be formed as a single piece via a series of stamping operations.

FIG. 18 discloses another embodiment of a trim plate 300 with similar features to the trim plate depicted in FIG. 17, however the trim plate 300 in FIG. 18 does not include the flange because it is configured to be inserted into an adaptor 110*a* such as depicted in FIG. 19. However, because of the circular shape of the trim plates depicted in FIGS. 17 and 18, both trim plates are configured to engage and rotate with the orientation ring 145.

To mount an adaptor, such as adaptor 110*a*, generally requires that the adaptor be aligned with the surface 5. It should be noted, however, that a number of variations in the thickness of the surface 5 may exist. Therefore, it is advantageous to provide a single luminaire that can mount to a range of thickness. It has been determined that a range in adjustability between about ½ of an inch and 1 and ⅝ of an inch covers the majority of ranges needed. Therefore, an embodiment of a luminaire that can accommodate such a range may be suitable for installation in most jobs while minimizing manufacturing costs. Of course, a luminaire with a great flexibility is possible. For example, by extending the height of the outer sleeve 90 and the length of the slots 91, a greater range of surface thicknesses can be accommodated.

FIGS. 20*a*-22*b* illustrate embodiments of a system for orientating an adaptor 110 with respect to surface. While a square shaped adaptor 110 is illustrated, any other desirable shape may be also installed in a similar manner. As previously noted, the ring gear 220 supports the orientation ring 145 and the orientation ring 145 can be rotated with respect to the ring gear 220. The ring gear 210 is in turn supported by an inner sleeve 220. As depicted, the inner sleeve 220 includes retaining tabs 223 that may be bent over so as to engage notches (not shown) in the ring gear 210. In such a manner, the ring gear 210 and the inner sleeve 220 may be securely coupled together. The orientation ring 145 rests on the teeth 212 of the ring gear 210 (which may be configured to provide a smooth sliding surface) and the orientation ring 145 is held in position by spacing ring 271 (FIG. 23). Thus, once the orientation ring 145 is placed on the ring gear 210, the spacing ring 271 may be installed so as to prevent the orientation ring 145 from being lifted out of the inner sleeve 220 while still being allowed to rotate with respect to inner sleeve 220. It should be noted that the inner sleeve 220 is omitted from FIGS. 21*a* and 21*b* so as to show other details.

Figure 20B:
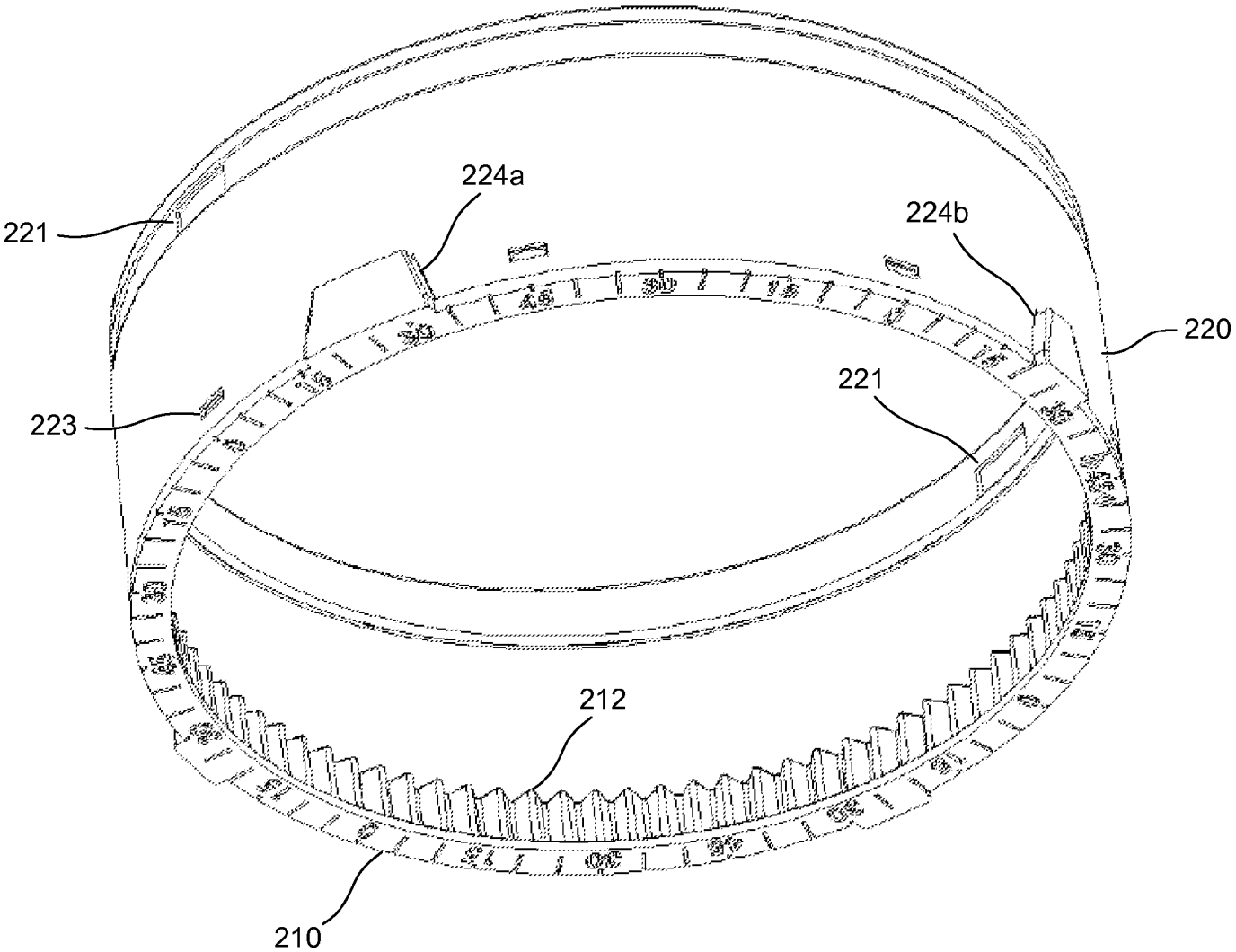
FIG. 20*b* illustrates an isometric view of another embodiment of an inner sleeve and ring gear.
Figure 32:
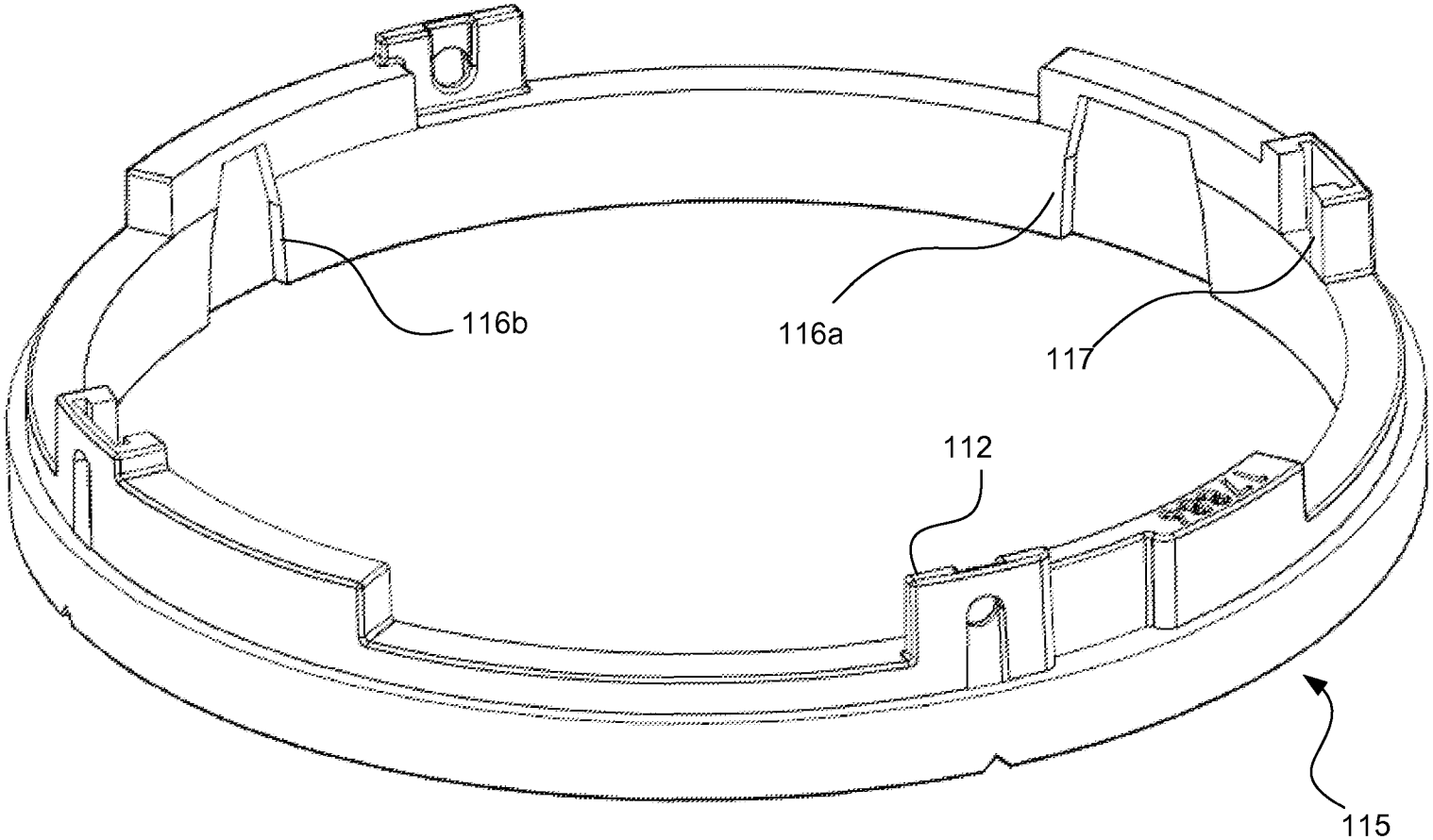
FIG. 32 illustrate an isometric view of an embodiment of a outer sleeve ring that may be formed as part of an adaptor.

The inner sleeve 220 also includes a plurality of notches 221 and retaining fingers 94, which are mounted to the outer sleeve 90, engages those notches 221 so as to securely support the inner sleeve 220 with respect to the outer sleeve 90. As depicted, the retaining fingers 94 are mounted to the outer sleeve 90 by fasteners 95 and the fasteners 95 also pass through projections 117 in outer sleeve ring 115 (FIG. 32) of adaptor 110. Thus, the adaptor 110, the outer sleeve 90 and the retaining fingers 94 are fastened together by fastener 95, which may be any suitable fastener such as a screw, rivet or the like. In addition, as depicted in FIG. 20*b*, the inner sleeve 220 also includes orientation tabs 224*a* and 224*b*. These tabs 224*a*, 224*b* are configured to engage corresponding notches 116 of outer sleeve 90. An advantage of this configuration is the tabs and notches can be configured to allow a single installation orientation. A further advantage of the use of the orientation tabs 224*a*, 224*b* is the orientation of the inner sleeve 220 and fingers 94 is controlled so that when the inner sleeve 220 is fully inserted, the fingers 94 readily engage the notches 221 without the need to verify alignment and/or to adjust the position of the inner sleeve 220 with respect to the outer sleeve 90. The use of the orientation tabs 224*a*, 224*b* also help control the depth of insertion of the inner sleeve 220 into the outer sleeve 90 so that the notches 221 are not inadvertently inserted beyond the fingers 94. Furthermore, if the optional angle markings on ring gear 210 are provided, then the orientation tabs 224*a*, 224*b* make it easier to ensure that luminaire in a series is aligned to the same angle settings (which can have the beneficial effect of allowing for simpler installation instructions).

Figure 6B:
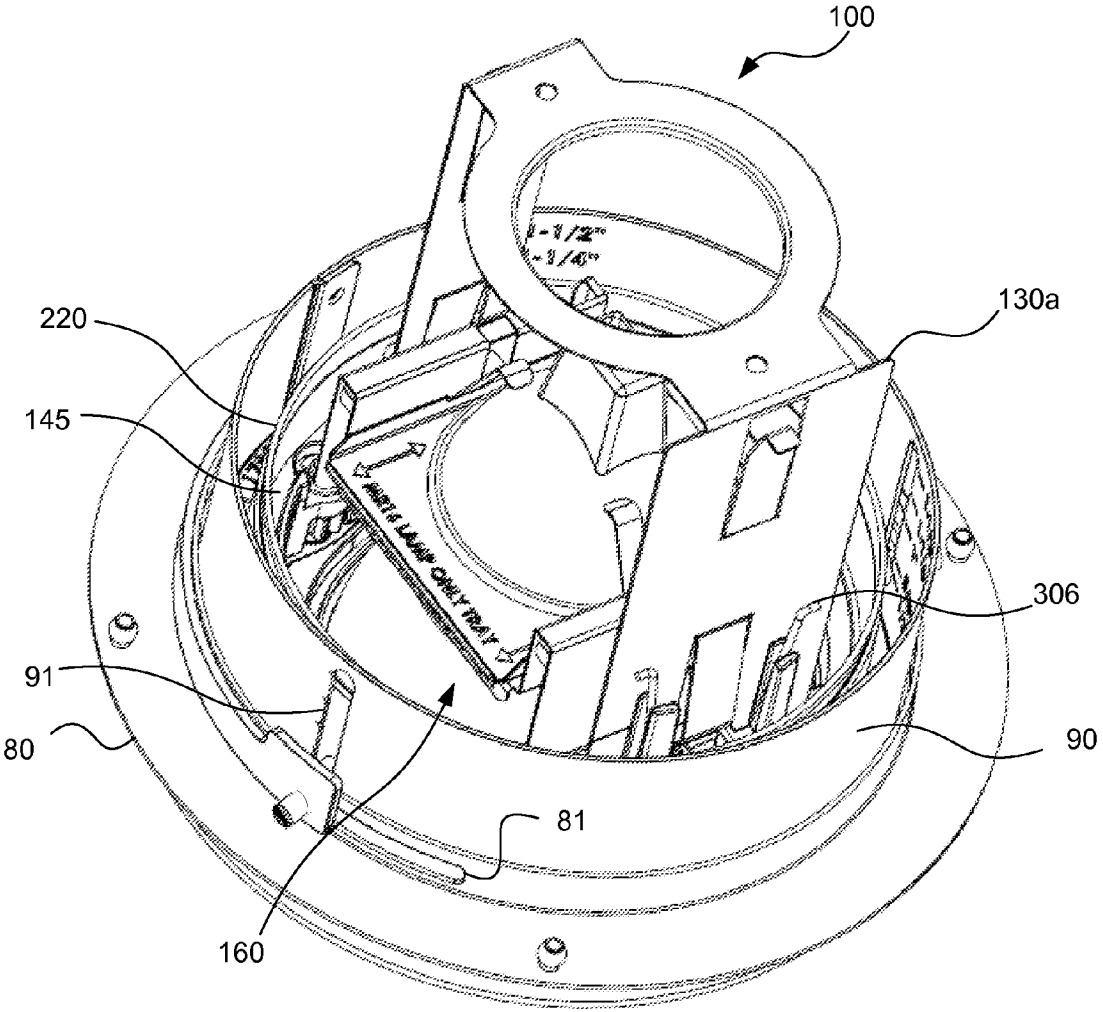
Figure 22A:
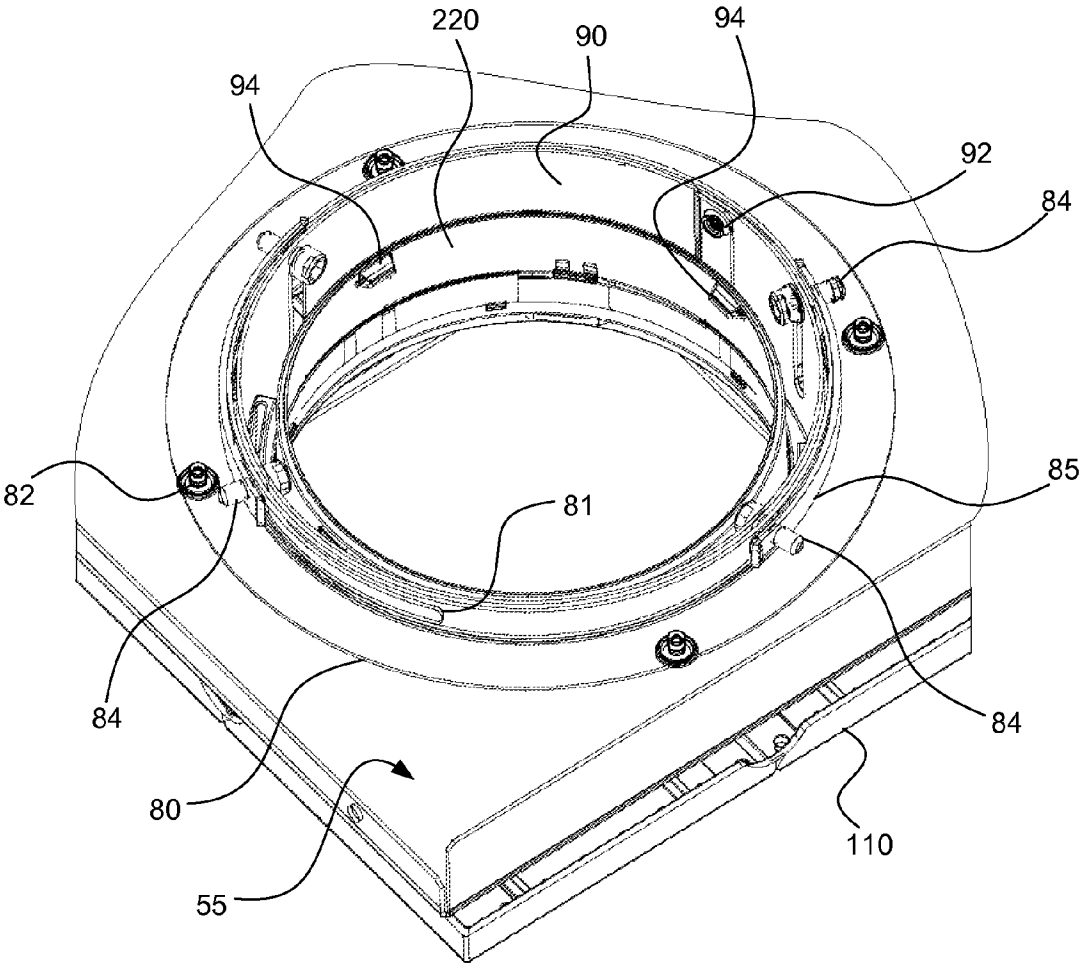
FIG. 22*a* illustrates an isometric view of an embodiment of an inner sleeve adjustably positioned with respect to a support panel of a housing.
Figure 22B:
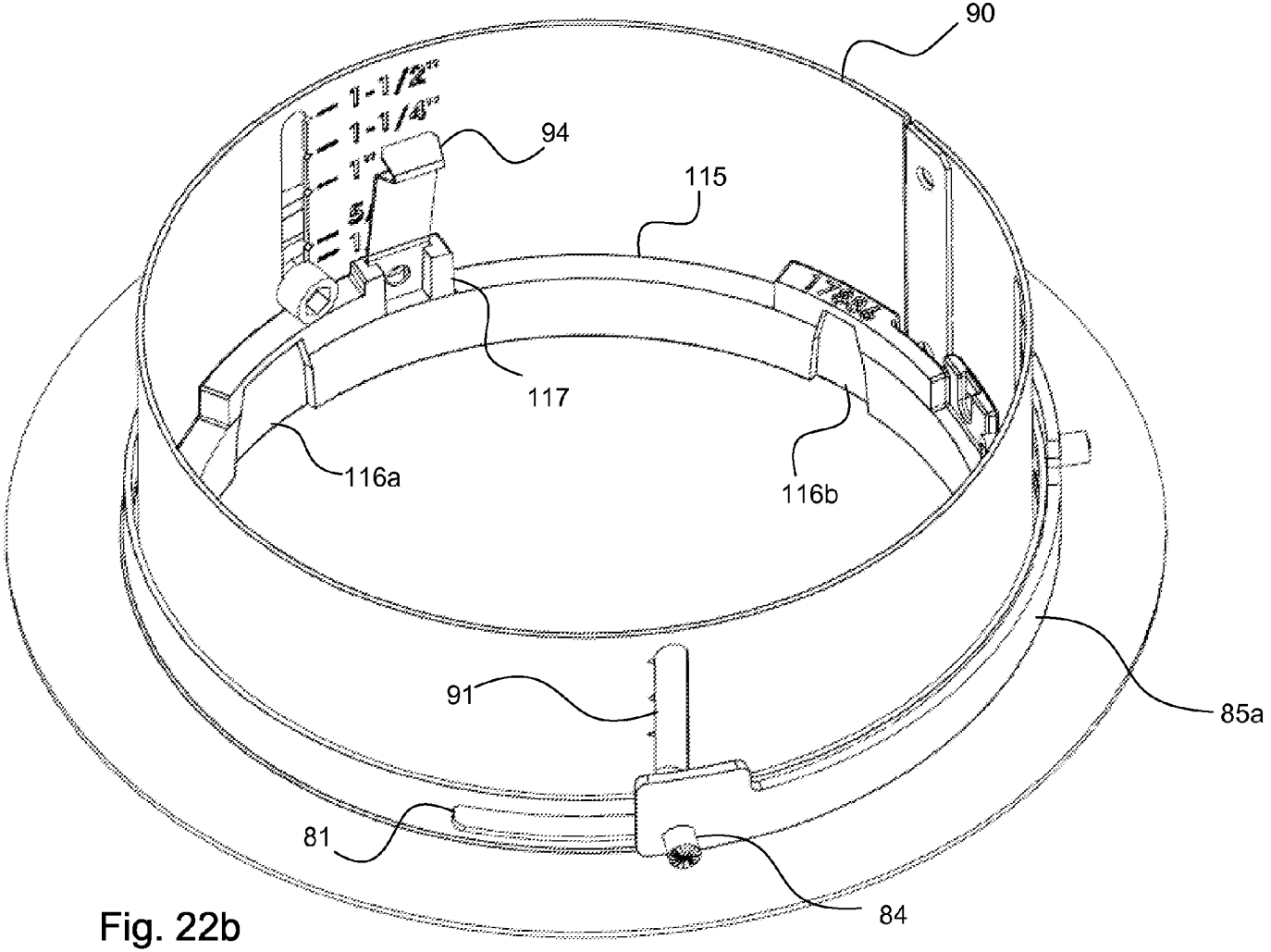
FIG. 22*b* illustrates an isometric view of an embodiment of an outer sleeve adjustably positioned with respect to a flange support.

The outer sleeve 90, which may be held together by a plurality of fasteners, is also supported by flange support 80, which is mounted to support panel 55. In an embodiment, four slots 91 in the outer sleeve 90 are engaged by fasteners 84 that screw into curved members 85. In another embodiment, as shown in FIG. 22*b* and FIG. 6*b*, three slots 91 in the outer sleeve 90 are engaged by fasteners 84 that extend through a single curved member 85*a* as well as the outer sleeve ring 115 of the adaptor 110. It should be noted that in an embodiment, the sleeve ring 115 may be formed as part of the adaptor 110; however, the outer sleeve ring 115 may also be joined to the adaptor 110 in a conventional manner. In an embodiment, the flange support 80 includes slots 81 that allow the outer sleeve to rotated with respect to the flange support 80 over a range of about ninety degrees, although some other range may be also be suitable. The advantage of having about ninety degrees of range is that the adaptor can be readily aligned with other installed adaptors and/or walls or other structural objects. It should be noted that some other number of slots could also be used to control the orientation of the outer sleeve 90 with respect to the flange support 80. In addition, the single curved member 85 (FIG. 22*b*) could be replaced with a number of smaller members. In an embodiment, as discussed elsewhere, the flange support 80 may be integrated into the support panel 55.

As can be appreciated from FIGS. 20*a*-22*b*, the adaptor 110 is fastened to the outer sleeve 90 and the outer sleeve 90 is fastened to the inner sleeve 220, which supports the orientation ring 145. As the orientation ring 145 supports the aiming frame 130, adjusting the orientation of the outer sleeve 90 not only adjusts the orientation of the adaptor 110 but it also adjusts the orientation of the inner sleeve 220 and aiming mechanism 100 (which may include the aiming frame 130, the tray system 160 and the orientation ring 145). However, since the orientation of the outer sleeve 90 can also be adjusted with respect to the housing 50, the adaptor can be positioned with respect to a surface, even if the housing 50 was not perfectly aligned. Thus, the depicted design allows the installer to desirably orientate the aiming mechanism in a substantially orthogonal and flush orientation with respect to the surface even if the orientation of the housing is skewed and the thickness of the surface varies. In other words, the luminaire 10 may be designed so that the inner sleeve 220 is configured to be adjustably installed with respect to the housing 50 and the aiming mechanism 100 can adjust the orientation of the bulb 20 with respect to the inner sleeve 220. It should be noted that in the depicted embodiment, the orientation of the outer sleeve 90 (and inner sleeve) can be said to be infinitely adjustable with respect to the housing 50 over the provided range because it can be adjusted vertically (within a given range) to account for ceiling surface thickness variations and can also be tilted so as to adjust pitch, roll and yaw (yaw adjustment is provided because of slots 81 in the flange support 80). As the depicted embodiment allows these adjustments to be made linearly between the outer limits of the orientation adjustment features, the ability to adjust the orientation in infinitesimal increments provides what is being referred to herein as infinite adjustability. While infinite adjustability has the advantage of allowing a more perfect fit, it may not be required for certain embodiments.

Figure 21A:
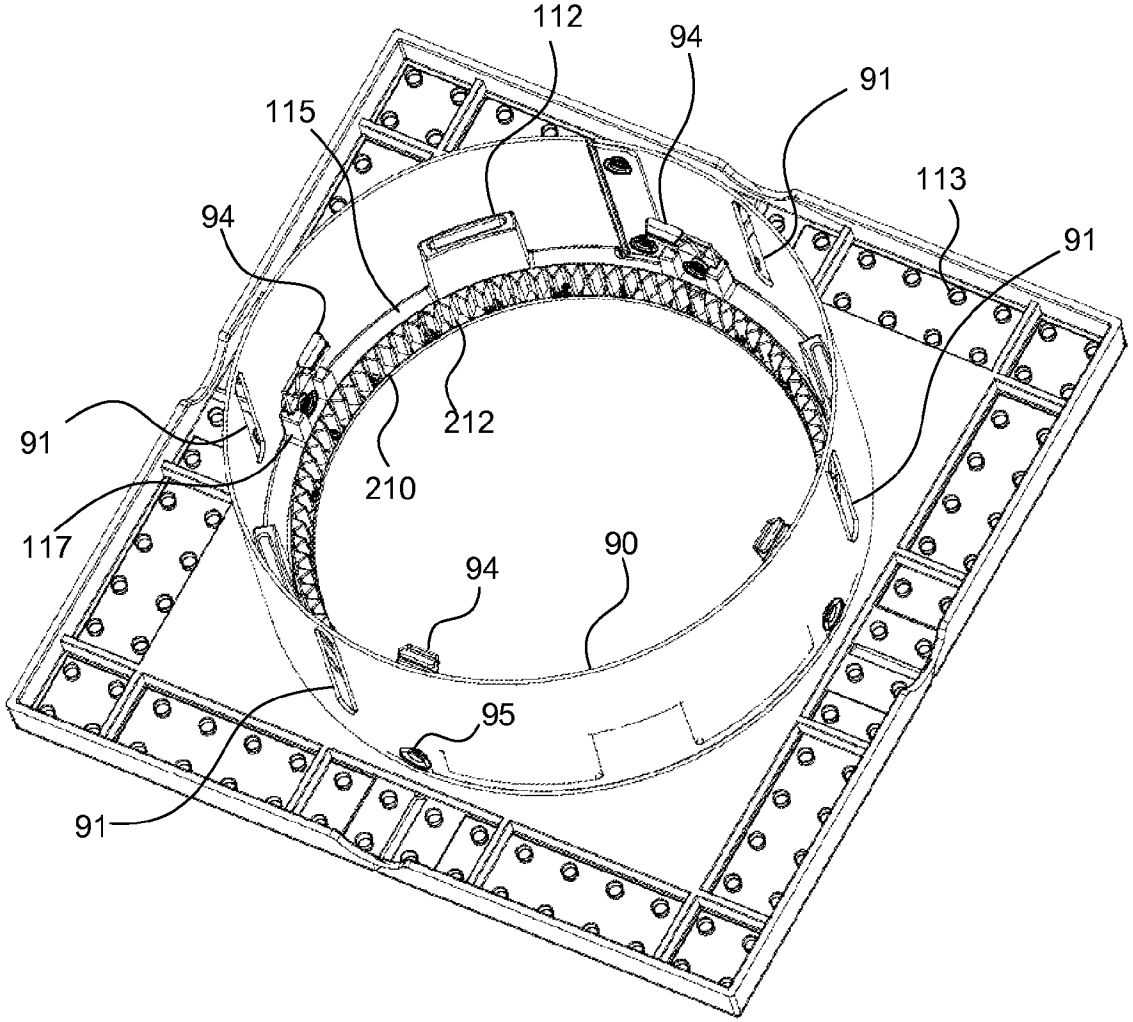
FIG. 21*a* illustrates an isometric view of an embodiment of an adaptor and an outer sleeve.
Figure 21B:
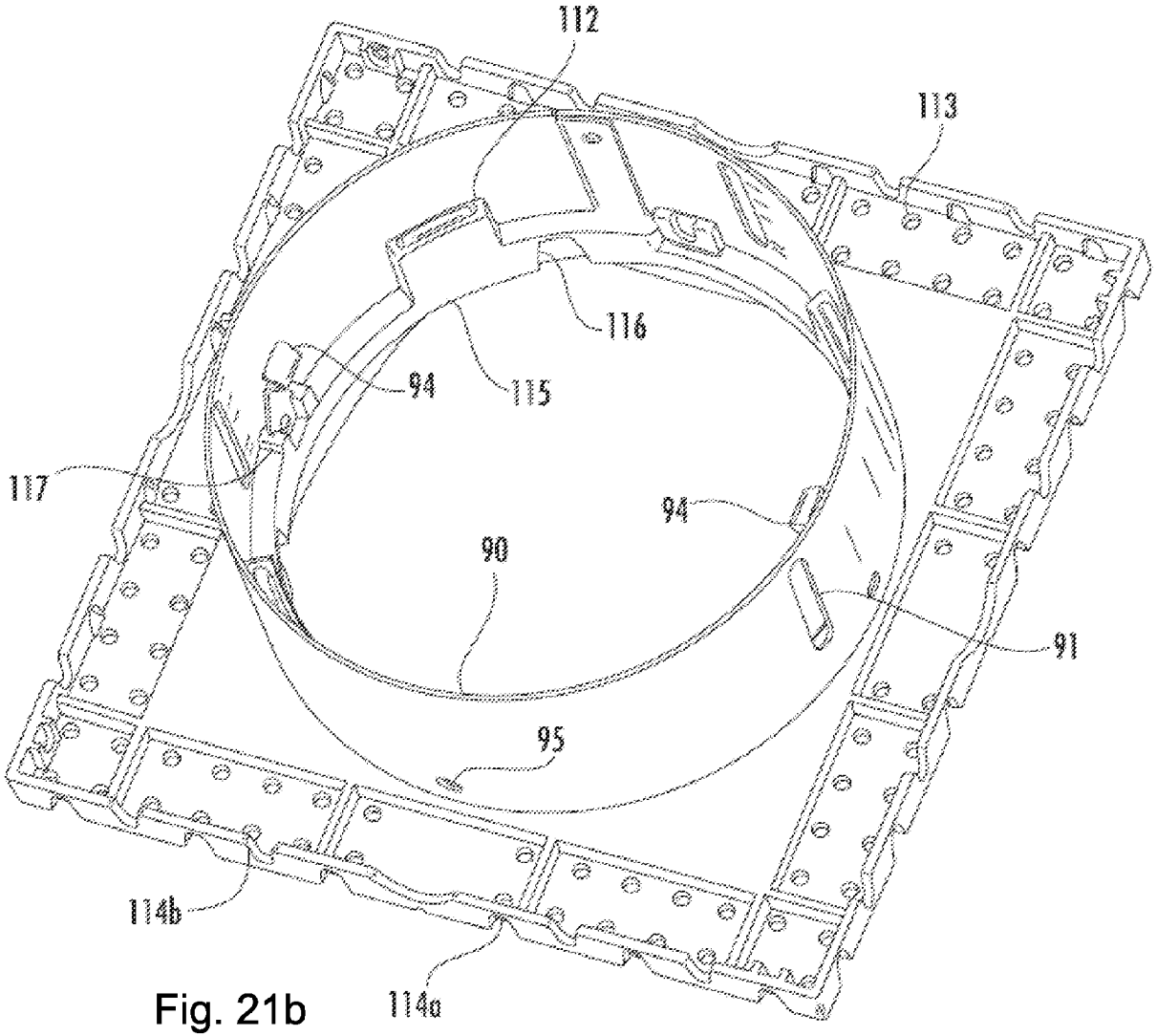
FIG. 21*b* illustrates an isometric view of another embodiment of an adaptor and an outer sleeve.

As can be appreciated from FIG. 21*b*, the adaptor 110 may include apertures 113 and cutouts 114*a*, 114*b*, which are both examples of plaster retaining features. While not required, plaster retaining features provide the advantage of helping to secure drywall mud or plaster to the adaptor 110 so that the adaptor may be more readily and securely integrated into a surface, and potentially reducing the occurrence of later cracking. Once the adaptor 110 is installed and the aiming system 100 is inserted, the orientation of the bulb 20 (with regards to angular and rotation orientation) may then be adjusted. It should be noted, however, that while a circular-shaped trim plate 300 can readily rotate with the orientation ring 145, a square-shaped trim plate cannot. It should also be noted that regardless of the shape of the trim plate 300, it may include a sealing material placed between the trim plate 300 and the adaptor 110 or between the trim plate 300 and the surface 5 so as to minimize intrusion of dust and moisture into the luminaire 10.

Figure 24:
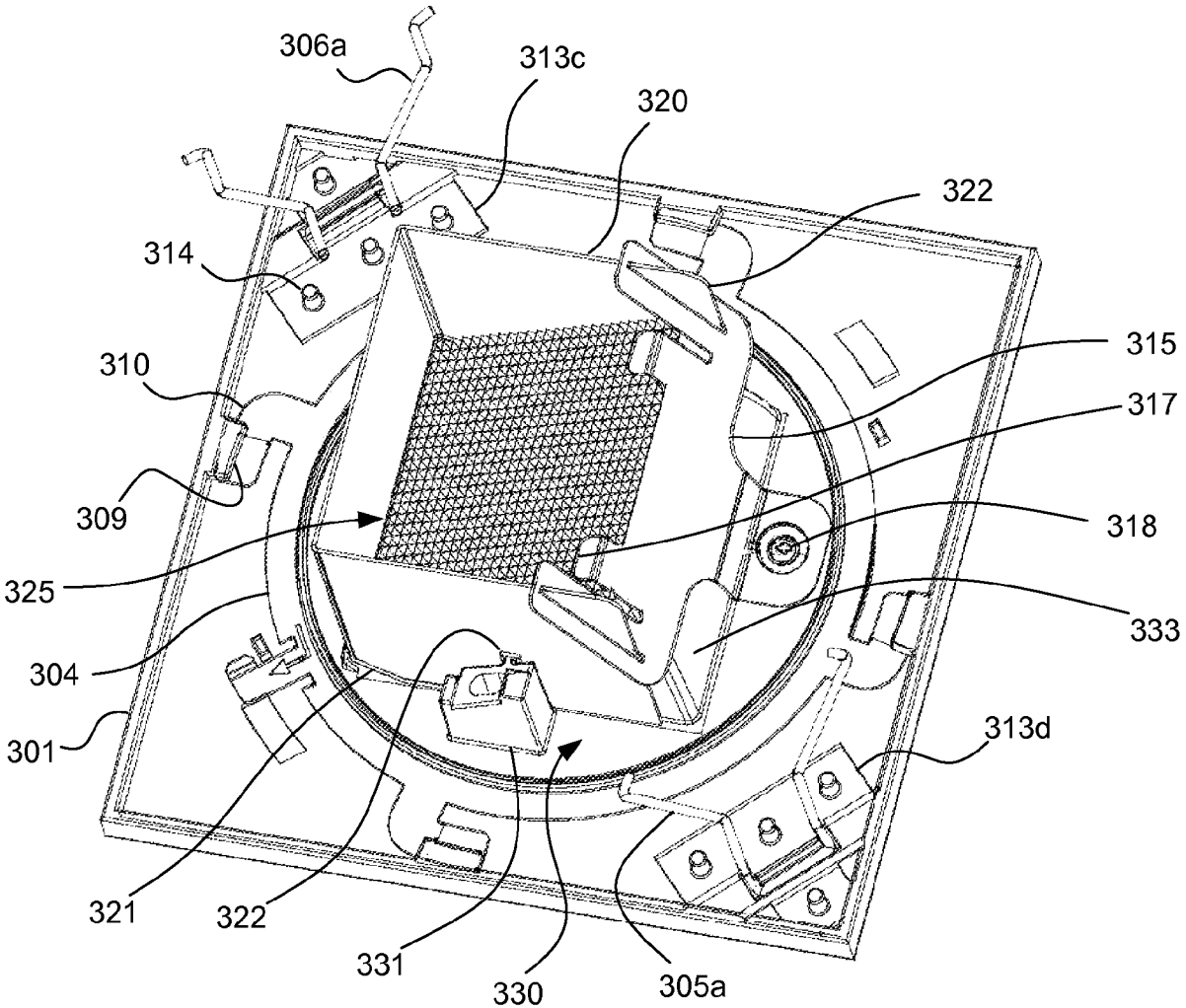
FIG. 24 illustrates an isometric view of an embodiment of a trim plate with an aperture medium mounted to the trim plate.

FIG. 24 illustrates an embodiment of a square trim plate 300. The retaining arms 306*a* and 305*a*, which are supported by brackets 313*c* and 313*d*, respectively, function similar to the retaining arms 306 and 305 but engage elongated channels 112 (FIG. 21*b*) in the adaptor 110 rather than the features in the orientation ring 145. Thus, the orientation ring 145 is free to move separately from the trim plate 300 depicted in FIG. 24. It should be noted that other non-circular shaped covers may be similarly configured with respect to how they are attached to the adaptor 110.

FIG. 24 also illustrates an additional feature, a square light emitting aperture with a wall-wash attachment. In general, the use of a square adaptor 110 and trim plate 300 typically calls for an installation that is parallel to a wall, if the luminaire is mounted in a ceiling for example. In addition, most installations will direct the light either down or parallel to two the edges of the trim plate 300, thus the rotation orientation of the tray system is less critical and typically will not be needed except to make minor adjustments or to rotate the bulb 90 degrees (if the initial installation was off by 90 degrees). However, the angular orientation of the bulb may be adjusted to provide accent lighting (for example, to illuminate an object mounted on or near a wall).

While a number of different configurations are possible, FIG. 24 illustrates an embodiment with the wall-wash feature. In operation, light is transmitted from the bulb 20 and shines into a region bound by the reflector 320 and the retaining bracket 315. The light hits the diffuser 325 and then is directed at an angle so as to provide a broad and relatively even light distribution (e.g. for "washing" a wall with light). To hold the components in place, a plate 330 includes projections 331 that engage slots 321 in the reflector 320. The reflector 320 is also held in place by the retaining bracket 315, which includes slots 316 that engage corners 322 of the reflector 320. The retaining bracket 315 is secured to the plate 330 by a fastener 318.

It should be noted that other aperture mediums, such as the wall-wash, may also be used to direct the light and the wall-wash light is merely representative of one embodiment of an aperture medium. In general, aperture mediums can provide light effects that are more difficult to provide with lenses and accessories that might be mounted in the tray system 160 because of the distance between the tray system and the cover lens limits the ability to broadly direct light over a wide range of angles. Furthermore, while luminaires with square shaped covers typically are configured so the light is directed at 90 degree angles (e.g. parallel to once of the edges of the trim plate 300), embodiments of the fixture are not so limited. Furthermore, if other shapes such as ovals, triangle, stars or any other non-circular shape is used, the adjustment features discussed above will allow the orientation of the trim, the cover and the bulb to be adjusted as desired.

Figure 25A:
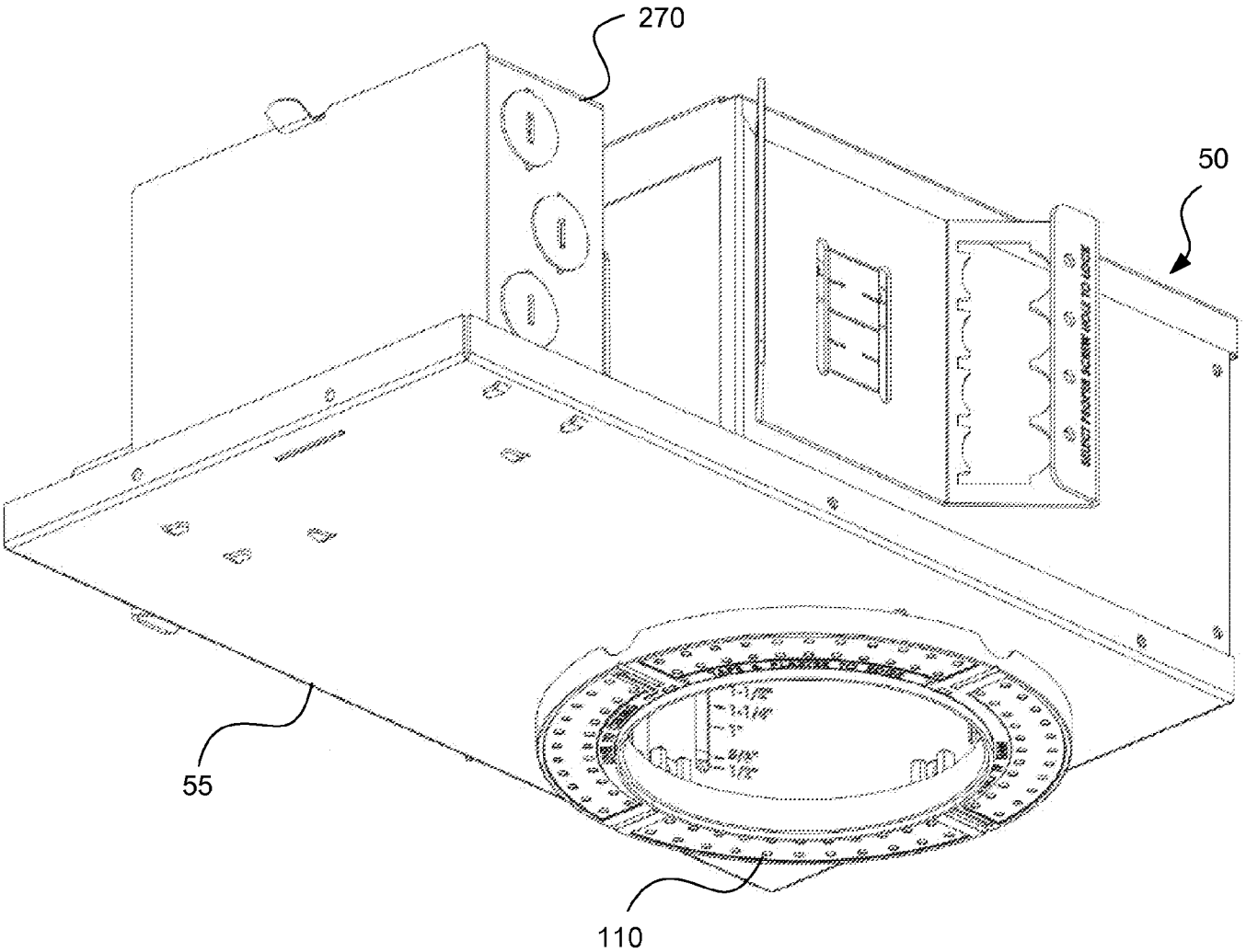
FIGS. 25*a*-27 illustrate isometric views of embodiments of luminaire housings that may be used in accordance with one or more aspects of the present invention.
Figure 25B:
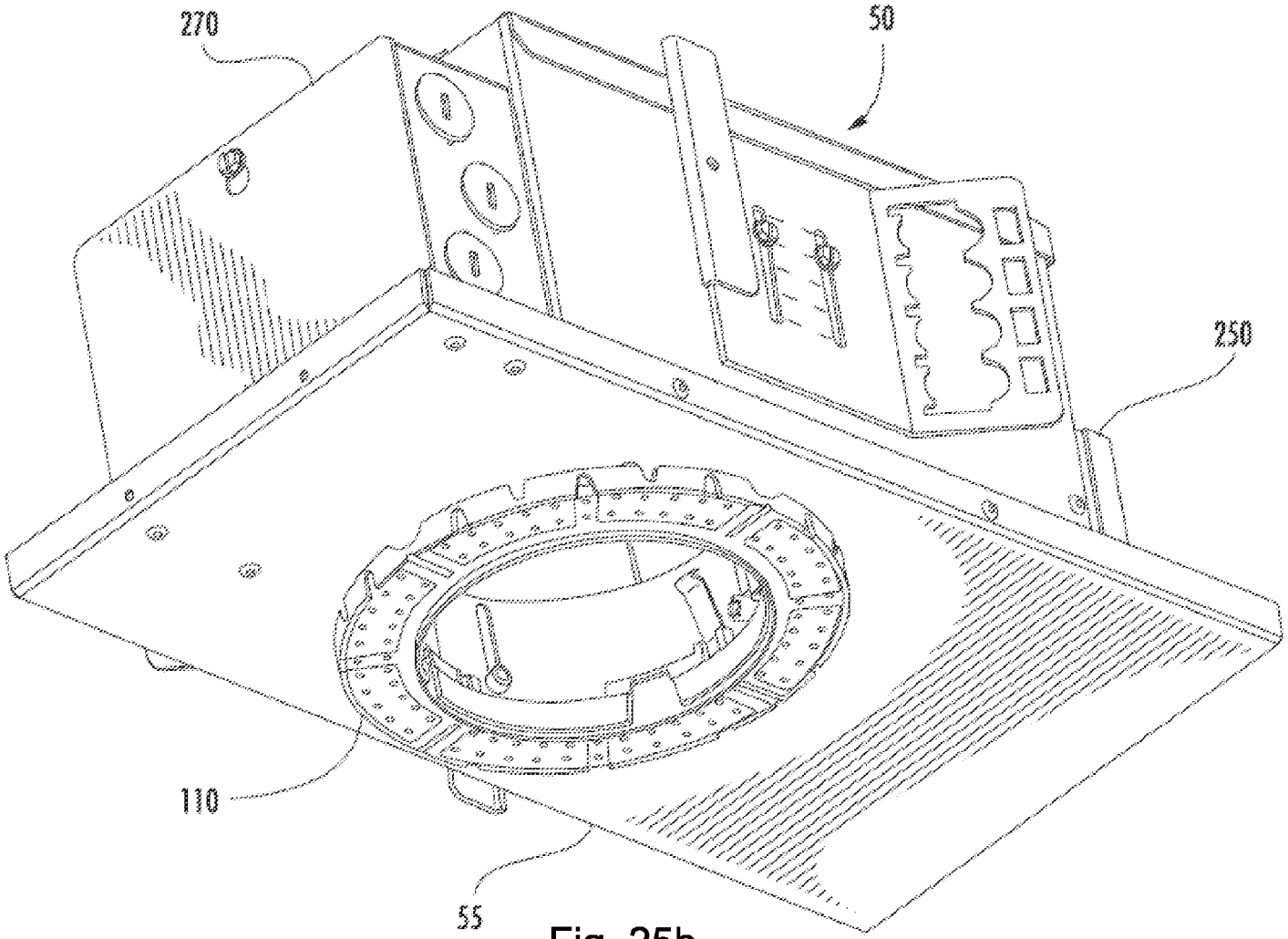

FIG. 25*a* illustrates another view of the housing depicted in FIG. 1. While numerous variations in the housing 50 are possible, such a configuration may be installed in a suspected ceiling or in a location where insulation is not intended to be in contact with the housing (for example, on internal walls or ceilings). FIG. 25*b* illustrates a similarly designed housing except that the junction box and the transformer are positioned in different locations. FIG. 25*b* also illustrates an embodiment of the adaptor 110 that is configured to be integrated into the drywall mud or plaster, as discussed above.

Figure 26:
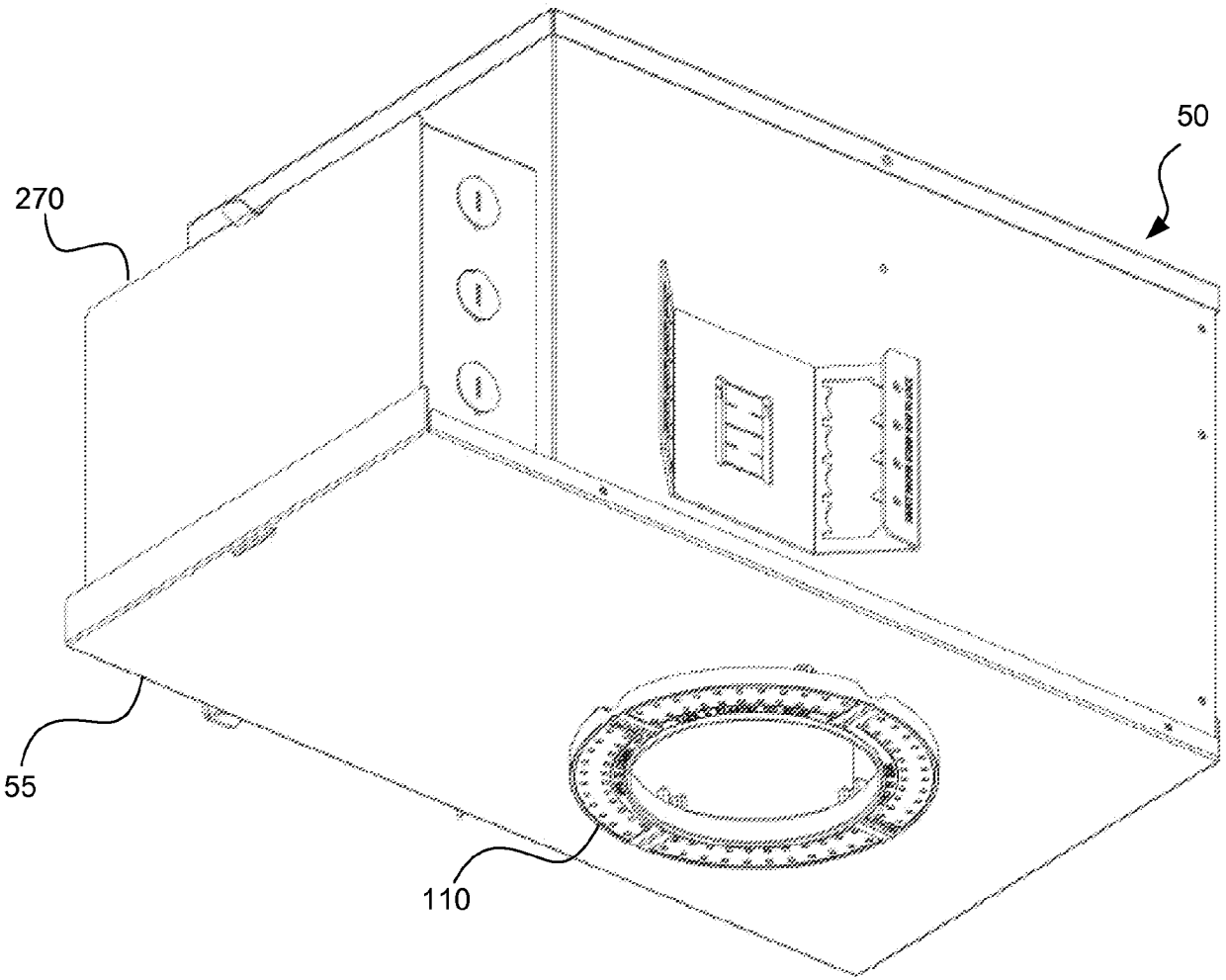

FIG. 26 illustrates a housing 50 that may be installed with insulation directly in contact with the housing 50. As can be appreciated, such a configuration may be desirable where the luminaire 10 is being installed in external walls or ceilings. For example, such a luminaire would be suitable to be installed in a ceiling with an empty space such as an attic above the luminaire 10. In such an installation configuration, it would be generally desirable to place substantially cover the luminaire 10 with insulation so as to prevent a draft from coming in through the luminaire 10 and the increased size of the housing 50, which can be appreciated based on the difference in the housing size between FIGS. 25 and 26 (where the junction box 270 is substantially the same size in both figures) can allow the luminaire 10 to be so installed. In an embodiment, the actual size of the housing 50 may be based on the wattage of the bulb 20 that the luminaire 10 is rated to accept.

Figure 27:
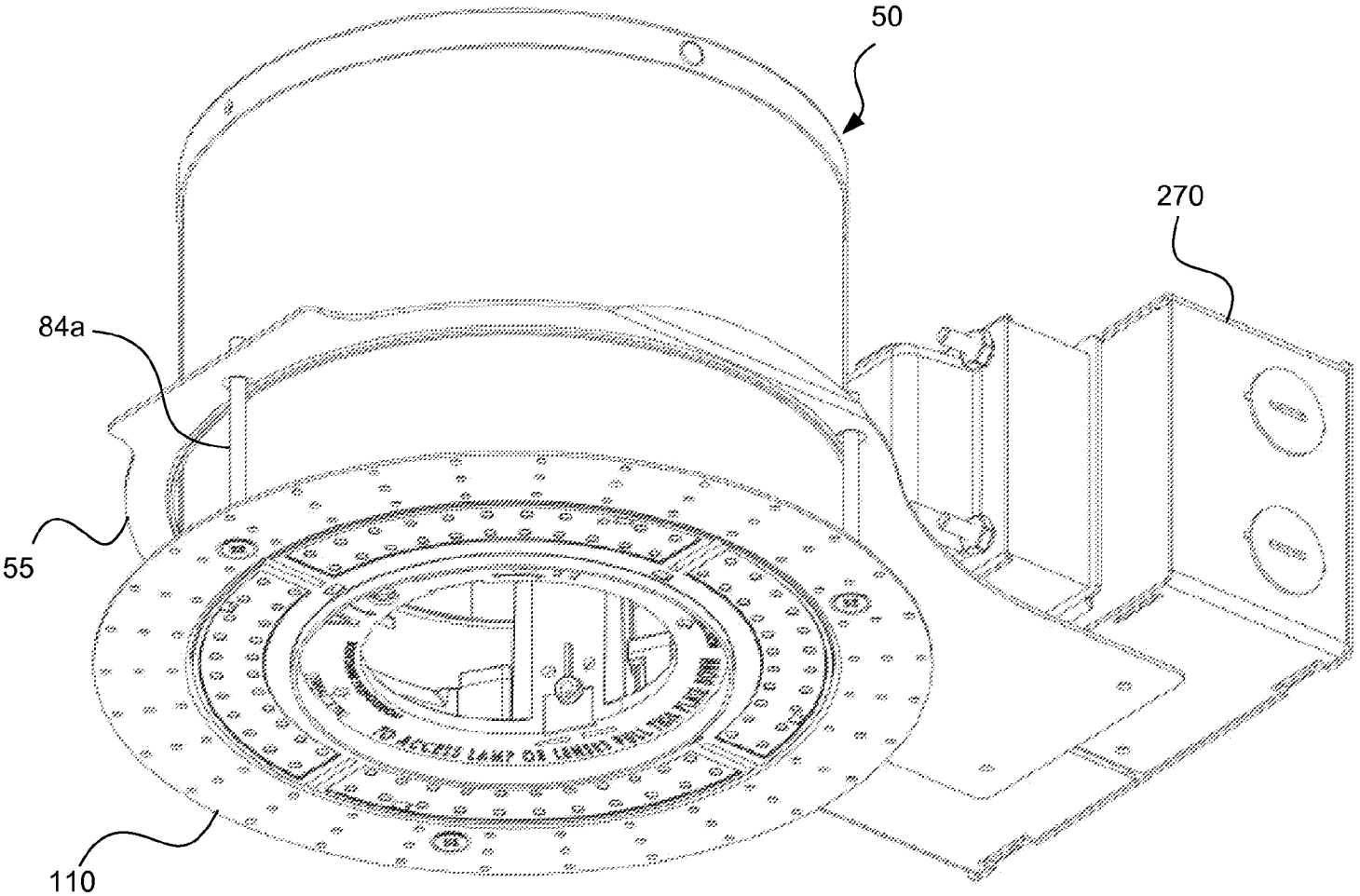

FIG. 27 illustrates another embodiment of a housing 50. As can be appreciated, the adaptor 110 is mounted to the support panel 55 via fasteners 84*a*. By adjusting the fasteners (rotating, for example, if the fasteners are screws), the vertical orientation of the adaptor 110 can be adjusted. Furthermore, because each of the three fasteners 84*a* can be separately adjusted, the roll and pitch of the adaptor 110, in addition to the vertical height, can be adjusted. Thus, in an embodiment where screws are used for the fasteners 84*a*, the orientation of the adaptor 110 can be considered infinitely adjustable, within the range of the fasteners 84*a*. As noted above, the adaptor 110 can allow the orientation of the orientation ring 145 to be adjusted with respect to the housing 50. However, as can be appreciated, because there is no reason to rotate a circular shaped adaptor 110, the ability to adjust yaw is unnecessary. FIG. 27 thus illustrates a housing 50 that may be mounted in a location where an existing luminaire was installed. Thus, FIG. 27 illustrates an embodiment of a housing 50 that would allow an individual to install a luminaire 10 with one or more of the desirable features discussed above in a location that was already finished without the need to remove a large portion of the finished surface.

Figure 28:
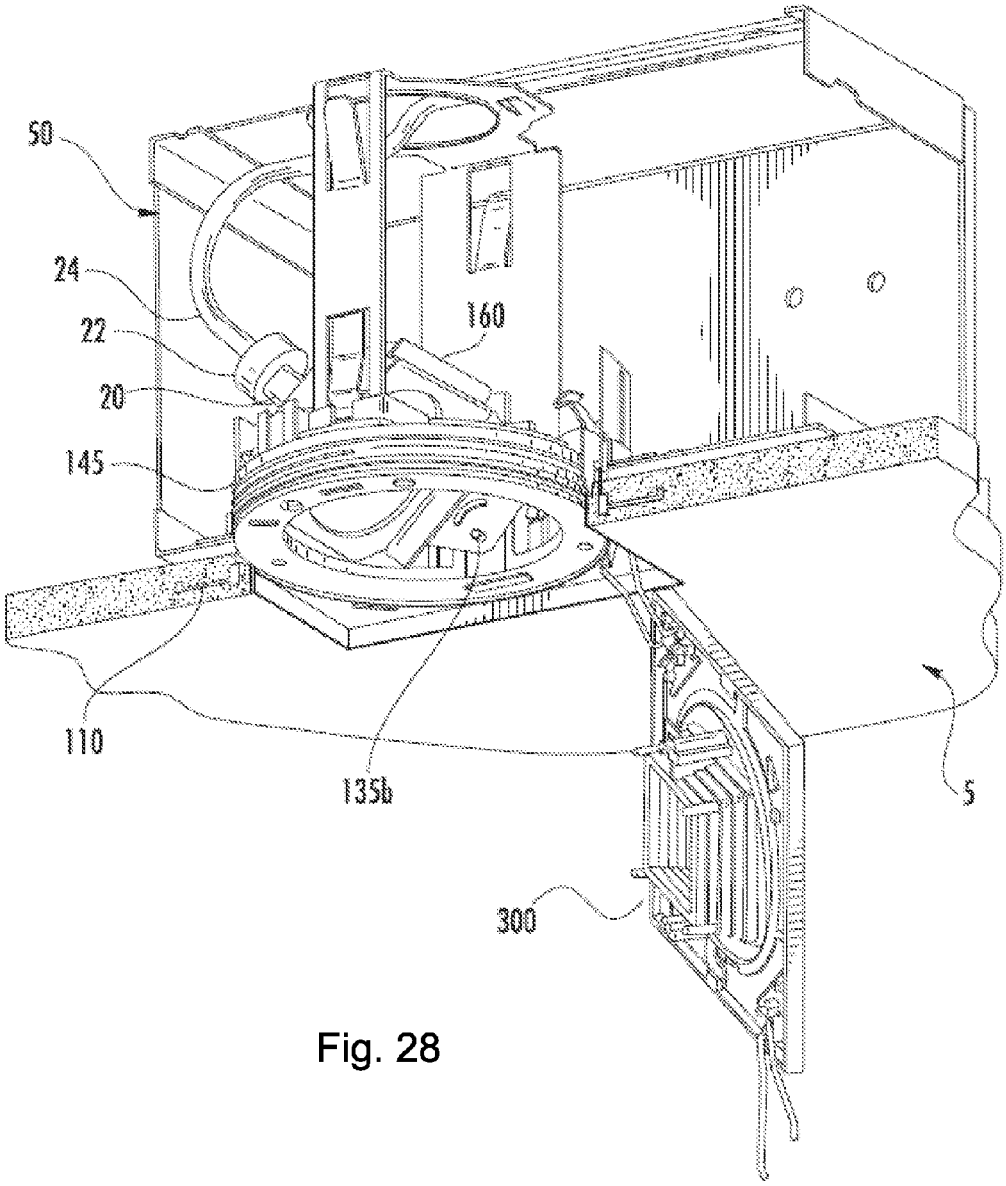
FIGS. 28-31 illustrate an embodiment of a luminaire in a variety of positions so as to represent steps that may be used to allow a bulb to be replaced in accordance with one or more aspects of the present invention.

FIGS. 28-31 illustrate cut-away views of a luminaire 10 that has been mudded into place in surface 5 so as to illustrate how a bulb 20 may be replaced. Similar functionality may be provided with a luminaire that is not mudded into place. FIG. 28 illustrates the trim plate 300 in a partially dissembled state and the tray system 160 is shown rotated about the fastener 135*b* (e.g., in a predetermined angular orientation). In particular, FIG. 28 illustrates an embodiment of a luminaire 10 configured to direct light from the bulb 20 at a predetermined angle of about 45 degrees from vertical. Furthermore, the aiming frame 130 is in an installed (or first) position. The bulb 20 is shown coupled to the wire 24 via the connector 22.

Figure 29:
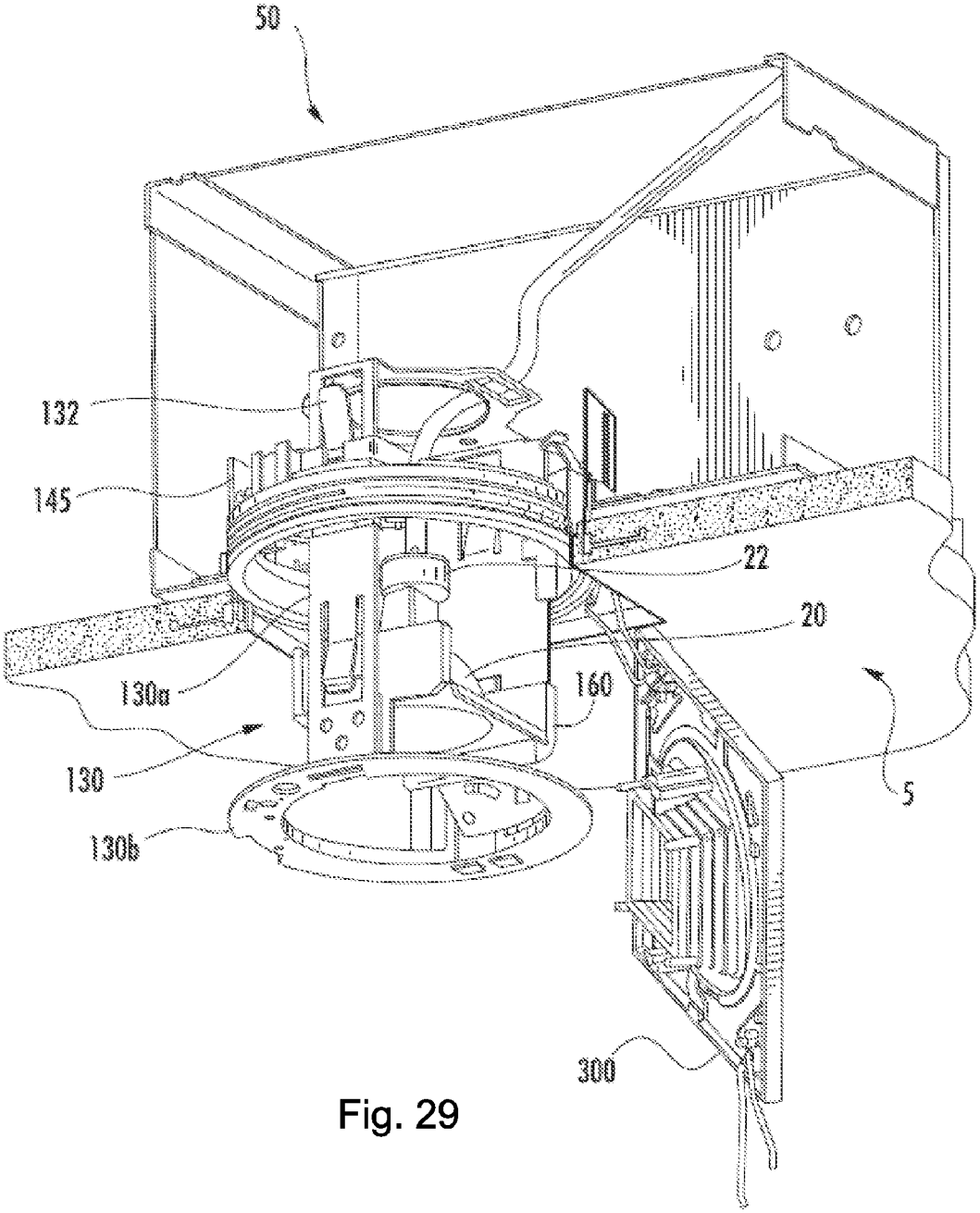
Figure 30:
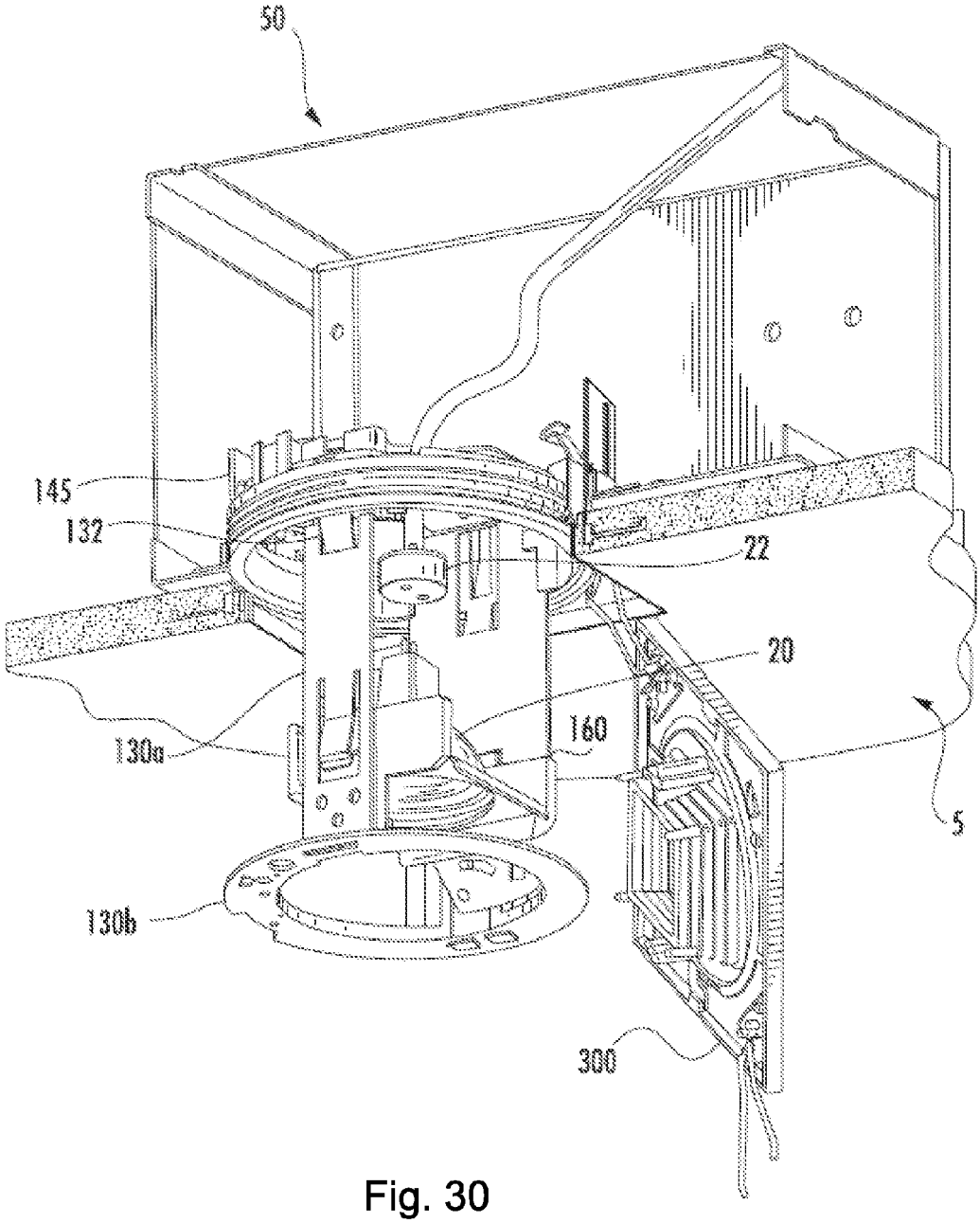

FIG. 29 illustrates the aiming frame 130, which as depicted includes upper section 130*a* and lower section 130*b*, between the installed (or first) position shown in FIG. 28 and a bulb changing (or second) position as shown in FIG. 30. However, the restraining arms 132 have not engaged the orientation ring 145. As depicted, the tray system 160 is vertically aligned due to the interaction between the locking arm 134 and the locking feature 166. The connector 22, as depicted, is somewhat accessible to the user.

Figure 31:
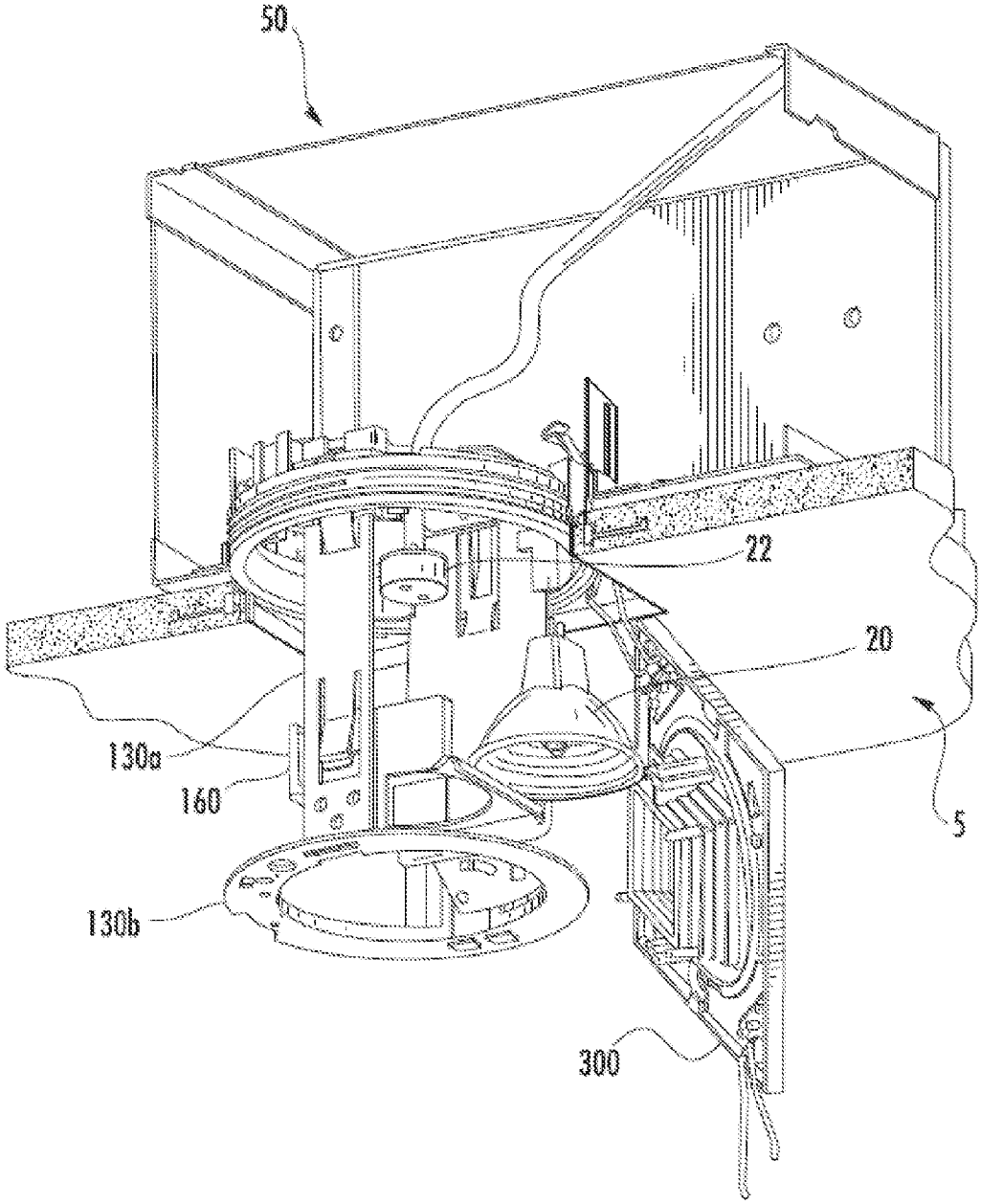

FIGS. 30-31 illustrates the aiming frame in the bulb changing (or second) position. The connector 22 is depicted as being disconnected from the bulb 20 and the restraining arms 132 have engaged the orientation ring 145 so as to prevent the aiming frame from being pulled further out of the housing 50. It should be noted that the order in which these steps happen is not critical. FIG. 31 illustrates the bulb 20 being removed from the tray system 160 so that a new bulb can be inserted.

Thus, as can be appreciated from FIGS. 28-31, the trim plate 300 can be removed, the aiming frame 130 pulled down, the bulb 20 can be replaced and then the process can be reversed. This allows the bulb to be quickly replaced, potentially with a single hand, without modifying the predetermined angle of the tray system 160 (or any lens accessories that may be mounted on the tray system 160). If just the trim plate 300 is removed (for example, as depicted in FIG. 28), then the angular or rotation orientation of the bulb can be adjusted while the bulb is still in operation.

The present invention has been described in terms of preferred and exemplary embodiments thereof. Numerous other embodiments, modifications and variations within the scope and spirit of the appended claims will occur to persons of ordinary skill in the art from a review of this disclosure.

We claim:

1. A system for controlling orientation of a bulb in a luminaire, comprising:

a frame that rotates about a central axis in response to rotation of a first rotational element;

a rotation drive of the first rotational element mounted to an orientation ring in the luminaire and including a pinion that engages a plurality of teeth included on a ring gear supported within the luminaire; and a tray mounted in the luminaire and holds the bulb, wherein the tray rotates in response to rotation of a second rotational element, wherein the first rotational element and the second rotational element are configured for simultaneous operation.

2. The system of claim 1, wherein the frame includes a lower portion with a first aperture and a second aperture, wherein the first rotational element is accessible through the first aperture and the second rotational element is accessible through the second aperture, such that the orientation of the bulb may be adjusted while the bulb is in operation.

3. The system of claim 1, wherein the tray includes a first tray configured to support the bulb and a second tray configured to support the first tray, wherein the first tray and the second tray are coupled by a biasing element that urges the first tray toward the second tray.

4. The system of claim 3, wherein the biasing element is a leaf spring.

5. The system of claim 3, wherein the biasing element is a plurality of coil springs.

6. The system of claim 1, wherein the orientation ring is supported by a sleeve that is adjustably mounted to the housing.

7. The system of claim 6, wherein the sleeve is configured to be infinitely adjustable within a predetermined range with respect to the housing.

8. The system of claim 7, wherein the sleeve is configured to be infinitely adjustable over a range of thicknesses between about one half of an inch and one and five eighths of an inch.

9. A system for supporting a bulb in a luminaire recessed in a surface; comprising:

a frame supported by the luminaire, the frame translatable between an installed position and a bulb changing position; and a tray including a retaining arm for retaining a bulb on the tray, wherein in operation, translation of the frame from the installed position to the bulb changing position causes the entire tray to extend below the surface so as to be visible, wherein the tray is a tray system comprising a first tray supported by the frame, a second tray supported by the first tray and a biasing element configured to urge the first and second tray together, wherein the second tray includes an arm for, in operation, retaining a bulb on the second tray.

10. The system of claim 9, wherein the frame is configured to be rotated about a central axis in response to rotation of a first rotational element.

11. The system of claim 10, wherein the tray is pivotally mounted in the luminaire and the tray rotates about the pivotally mounting in response to rotation of a second rotational element.

12. The system of claim 11, wherein the first rotation element and the second rotational element are configured for simultaneous operation.

13. The system of claim 9, wherein the biasing element is a leaf spring.

14. The system of claim 9, wherein the biasing element is a plurality of coil springs.

15. The system of claim 9, further comprising a lens position between the first and second trays, the lens held in a desired orientation by the biasing element acting on the first and second trays.

16. The system of claim 9, further comprising:

a rotation drive mounted to an orientation ring in the luminaire and including a pinion that engages a plurality of teeth included on a ring gear supported within the housing.

17. The system of claim 16, wherein the orientation ring is supported by a sleeve that is adjustably mounted to the housing.

18. The system of claim 17, wherein the sleeve is configured to be infinitely adjustable within a predetermined range with respect to the housing.

19. The system of claim 18, wherein the sleeve is configured to be infinitely adjustable over a range of thicknesses between about one half of an inch and one and five eighths of an inch.

20. A luminaire recessed in a surface, the luminaire comprising:

a frame translatable between an installed position and a bulb changing position;

a bulb supported in the frame;

a tray system including:

a retaining arm for retaining the bulb in the tray system, a first tray supported by the frame, a second tray supported by the first tray, and a biasing element configured to urge the first tray and the second tray together, wherein the translation of the frame from the installed position to the bulb changing position causes the entire tray system to extend below the surface so as to be visible.

21. The luminaire of claim 20, wherein the frame is configured to be rotated about a central axis in response to rotation of a first rotational element.

22. The luminaire of claim 21, wherein the tray system is pivotally mounted in the luminaire and the tray rotates about the pivotally mounting in response to rotation of a second rotational element.

23. The luminaire of claim 20, wherein the first rotation element and the second rotational element are configured for simultaneous operation.

24. The luminaire of claim 20, further comprising a lens position between the first and second trays, the lens held in a desired orientation by the biasing element acting on the first and second trays.

* * * * *